US010543655B2

(12) United States Patent
Awano et al.

(10) Patent No.: US 10,543,655 B2
(45) Date of Patent: Jan. 28, 2020

(54) BINDING MEMBER, BINDING DEVICE, AND IMAGE PROCESSING APPARATUS

(71) Applicant: FUJI XEROX CO., LTD., Tokyo (JP)

(72) Inventors: Hiroaki Awano, Yokohama (JP); Yoshinori Nakano, Yokohama (JP); Takuya Makita, Yokohama (JP); Junichi Hirota, Yokohama (JP); Hiroshi Hagiwara, Ebina (JP); Emiko Shiraishi, Yokohama (JP); Yasuhiro Kusumoto, Kanagawa (JP); Kojiro Tsutsumi, Yokohama (JP); Toshiyasu Yukawa, Yokohama (JP); Katsumi Harada, Yokohama (JP)

(73) Assignee: FUJI XEROX CO., LTD., Tokyo (JP)

( * ) Notice: Subject to any disclaimer, the term of this patent is extended or adjusted under 35 U.S.C. 154(b) by 80 days.

(21) Appl. No.: 15/777,852

(22) PCT Filed: Mar. 15, 2017

(86) PCT No.: PCT/JP2017/010446
§ 371 (c)(1),
(2) Date: May 21, 2018

(87) PCT Pub. No.: WO2017/169791
PCT Pub. Date: Oct. 5, 2017

(65) Prior Publication Data

US 2018/0370177 A1 Dec. 27, 2018

(30) Foreign Application Priority Data

Mar. 31, 2016 (JP) ..... 2016-071437
Feb. 1, 2017 (JP) ..... 2017-016876

(51) Int. Cl.
*B31F 5/02* (2006.01)
*B65H 37/04* (2006.01)
*G03G 15/00* (2006.01)

(52) U.S. Cl.
CPC ..... *B31F 5/02* (2013.01); *B65H 37/04* (2013.01); *B31F 2201/00* (2013.01); *G03G 15/6544* (2013.01)

(58) Field of Classification Search
CPC ..... B65H 2301/43828; B65H 2301/51616; B65H 37/04; B31F 5/02; G03G 15/6544
See application file for complete search history.

(56) References Cited

U.S. PATENT DOCUMENTS 6,089,401 A 7/2000 Salaker
7,531,062 B2 5/2009 Kershaw et al.
(Continued)

FOREIGN PATENT DOCUMENTS

CN 1167724 A 12/1997
CN 102596583 A 7/2012
(Continued)

OTHER PUBLICATIONS

Communication dated Apr. 24, 2019, issued by the Chinese Patent Office in counterpart Chinese Application No. 201780006512.0.
(Continued)

*Primary Examiner* — Jennifer E Simmons
(74) *Attorney, Agent, or Firm* — Sughrue Mion, PLLC

(57) ABSTRACT

There is provided a binding member. An upper toothed part having projections and recesses for forming irregularities in a bundle of recording materials. A lower toothed part having projections and recesses for forming irregularities in the bundle of recording materials and forming a pair with the upper toothed part. In at least one of the upper toothed part and the lower toothed part, in a cross section shape of the
(Continued)

toothed part, the recesses of the toothed part have depressed areas depressed from virtual lines which are extensions of inclined surfaces of the toothed part.

9 Claims, 15 Drawing Sheets

(56) References Cited

U.S. PATENT DOCUMENTS

| | | | | |
|---|---|---|---|---|
| 2010/0202814 | A1 | 8/2010 | Nakamura | |
| 2012/0148372 | A1 | 6/2012 | Mori | |
| 2014/0138896 | A1* | 5/2014 | Yoshida | G03G 15/6544 270/58.11 |
| 2015/0030414 | A1* | 1/2015 | Takahashi | B42C 13/00 412/33 |
| 2015/0239587 | A1 | 8/2015 | Abe | |
| 2015/0344257 | A1* | 12/2015 | Tachibana | B65H 37/04 270/1.01 |

FOREIGN PATENT DOCUMENTS

| | | | |
|---|---|---|---|
| CN | 104755273 | A | 7/2015 |
| CN | 105392636 | A | 3/2016 |
| DE | 32 22 132 | A1 | 12/1983 |
| FR | 396544 | A | 4/1909 |
| JP | 2014-37310 | A | 2/2014 |
| JP | 5533122 | B2 | 6/2014 |
| JP | 2014-168890 | A | 9/2014 |
| WO | 2011/018897 | A1 | 2/2011 |
| WO | 2014/208237 | A1 | 12/2014 |

OTHER PUBLICATIONS

International Search Report (PCT/ISA/210) dated Jun. 6, 2017 issued by the International Searching Authority in counterpart International Application No. PCT/JP2017/010446.

Written Opinion (PCT/ISA/237) dated Jun. 6, 2017 issued by the International Searching Authority in counterpart International Application No. PCT/JP2017/010446.

* cited by examiner

BINDING MEMBER, BINDING DEVICE, AND IMAGE PROCESSING APPARATUS

CROSS-REFERENCE TO RELATED APPLICATIONS

This application is based on and claims priority under 35 USC 119 from Japanese Patent Application No. 2016-71437 filed on Mar. 31, 2016 and No. 2017-16876 filed on Feb. 1, 2017.

BACKGROUND

Technical Field

The present disclosure relates to a binding member, a binding device, and an image processing apparatus.

SUMMARY

According to an aspect of the present invention, there is provided a binding member including: an upper toothed part having projections and recesses for forming irregularities in a bundle of recording materials; and a lower toothed part having projections and recesses for forming irregularities in the bundle of recording materials and forming a pair with the upper toothed part. In at least one of the upper toothed part and the lower toothed part, in a cross section shape of the toothed part, the recesses of the toothed part have depressed areas depressed from virtual lines which are extensions of inclined surfaces of the toothed part.

BRIEF DESCRIPTION OF THE DRAWINGS

Exemplary embodiments of the present invention will be described in detail based on the following figures, wherein.

DETAILED DESCRIPTION

Hereinafter, an exemplary embodiment of the present invention will be described in detail with reference to the accompanying drawings.

<Configuration of Recording-Material Processing System>

Figure 1:
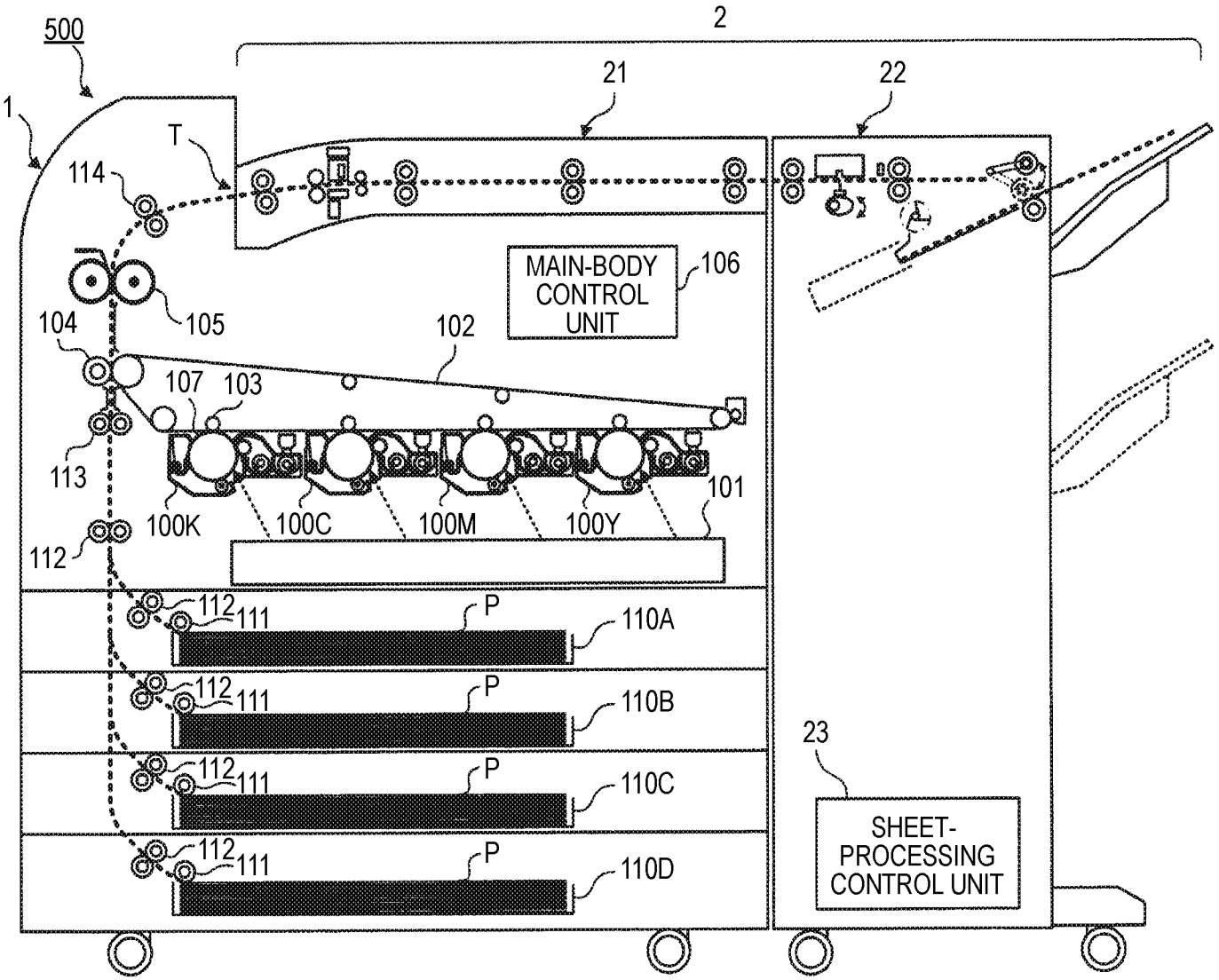
FIG. 1 is a view illustrating the configuration of a recording-material processing system according to an exemplary embodiment.

FIG. 1 is a view illustrating the configuration of a recording-material processing system 500 according to the exemplary embodiment of the present invention.

The recording-material processing system 500 serves as an example of an image processing apparatus, and includes an image forming apparatus 1 configured to form images on recording materials (sheets) such as sheets P in an electrophotographic manner by image forming units, and a post-processing apparatus 2 configured to perform post-processing on plural sheets P having images formed by the image forming apparatus 1.

The image forming apparatus 1 has four image forming units 100Y, 100M, 100C, and 100K (hereinafter, also referred to collectively as image forming units 100) configured to perform image formation on the basis of image data of individual colors. Also, the image forming apparatus 1 has a laser exposure unit 101 configured to expose photosensitive drums 107 included in the image forming units 100, thereby forming electrostatic latent images on the surfaces of the photosensitive drums 107.

Also, the image forming apparatus 1 has an intermediate transfer belt 102 onto which toner images of the individual colors formed by the image forming units 100 are transferred such that the toner images overlap, and primary transfer rollers 103 configured to sequentially transfer (primarily transfer) the toner images of the individual colors formed by the image forming units 100 onto the intermediate transfer belt 102. Further, the image forming apparatus 1 has a secondary transfer roller 104 configured to simultaneously transfer (secondarily transfer) the transferred toner images of the individual colors on the intermediate transfer belt 102 onto a sheet P, a fixing unit 105 configured to fix the secondarily transferred toner images of the individual colors to the sheet P, and a main-body control unit 106 configured to control the operation of the image forming apparatus 1.

In the image forming units 100, charging of the photosensitive drums 107 and formation of electrostatic latent images on the photosensitive drums 107 are performed. Also, developing of the electrostatic latent images is performed, whereby toner images of the individual colors are formed on the surfaces of the photosensitive drums 107.

The toner images of the individual colors formed on the surfaces of the photosensitive drums 107 are sequentially transferred onto the intermediate transfer belt 102 by the primary transfer rollers 103. Then, as the intermediate transfer belt 102 moves, the toner images of the individual colors are conveyed toward the position of the secondary transfer roller 104.

The image forming apparatus 1 has sheet storage units 110A to 100D, which contain sheets P having different sizes and different types. For example, a sheet P is drawn from the sheet storage unit 110A by a pickup roller 111, and is conveyed to a sheet stop roller 113 by conveying rollers 112.

Then, the sheet P is fed from the sheet stop roller 113 to a facing part (a secondary transfer part) in which the secondary transfer roller 104 and the intermediate transfer belt 102 face each other, according to the timing when toner images of the individual colors on the intermediate transfer belt 102 will reach the secondary transfer roller 104.

Then, the toner images of the individual colors on the intermediate transfer belt 102 are transferred (secondarily transferred) onto the sheet P at the same time by action of an electric field for transfer produced by the secondary transfer roller 104.

Thereafter, the sheet P having the toner images of the individual colors transferred thereon is peeled off from the intermediate transfer belt 102 and is conveyed to the fixing unit 105. In the fixing unit 105, the toner images of the individual colors are fixed on the sheet P by a fixing process using heat and pressure, whereby an image is formed on the sheet P.

The sheet P having the image formed thereon is discharged from a sheet discharge part T of the image forming apparatus 1 by the conveying rollers 114, and is supplied to the post-processing apparatus 2 connected to the image forming apparatus 1.

The post-processing apparatus 2 is disposed on the downstream side from the sheet discharge part T of the image forming apparatus 1, and performs post-processing such as punching or binding on sheets P having images formed thereon.

<Configuration of Post-Processing Apparatus>

Figure 2:
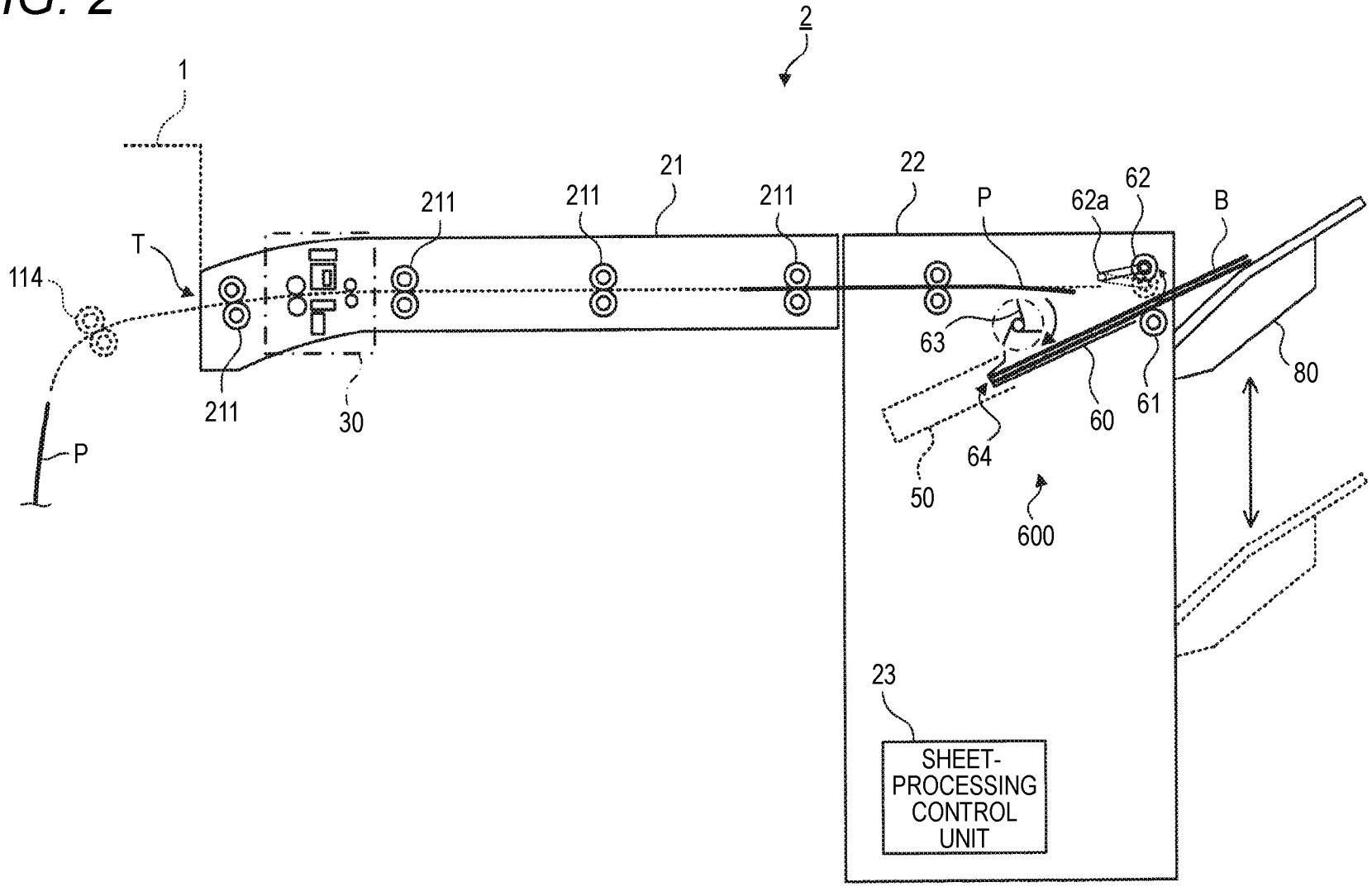
FIG. 2 is a view for explaining the configuration of a post-processing apparatus.

FIG. 2 is a view for explaining the configuration of the post-processing apparatus 2.

As shown in FIG. 2, the post-processing apparatus 2 includes a transport unit 21 connected to the sheet discharge part T of the image forming apparatus 1, and a finisher unit 22 configured to perform predetermined processing on sheets P received from the transport unit 21.

Also, the post-processing apparatus 2 includes a sheet-processing control unit 23 configured to control mechanism parts of the post-processing apparatus 2. The sheet-processing control unit 23 is connected to the main-body control unit 106 (see FIG. 1) via a signal line (not shown in the drawings), and transmits and receives control signals and so on to and from the main-body control unit.

Also, the post-processing apparatus 2 includes a stacker unit 80 on which sheets P (a bundle B of sheets) subjected to processing of the post-processing apparatus 2 are loaded.

As shown in FIG. 2, the transport unit 21 of the post-processing apparatus 2 has a punching unit 30 configured to form (punch) holes, for example, two holes or four holes.

Further, the transport unit 21 has plural conveying rollers 211 configured to convey sheets P having images formed in the image forming apparatus 1 toward the finisher unit 22.

The finisher unit 22 has a binding device 600 configured to perform a binding process on a bundle B of sheets which is an example of a bundle of recording materials. The binding device 600 of the present exemplary embodiment functions as an example of a binding unit, and performs a binding process on a bundle B of sheets without using staples.

The binding device 600 includes a sheet collection unit 60 configured to support sheets P from below until as many sheets P as needed are collected to make a bundle B of sheets. Also, the binding device 600 includes a binding unit 50 configured to perform a binding process on a bundle B of sheets. Also, the sheet collection unit 60 functions as an example of a holding unit for holding a bundle B of sheets which is a bundle of recording materials.

In the present exemplary embodiment, a binding process on a bundle B of sheets is performed by pressing advance members (to be described below) included in the binding unit 50 against the bundle B of sheets from both surface sides of the bundle B of sheets such that the sheets P constituting the bundle B of sheets are crimped (fibers constituting the sheets P are tangled).

Also, the binding device 600 includes a discharging roller 61 and a movable roller 62. The discharging roller 61 rotates clockwise in FIG. 2 to send a bundle B of sheets on the sheet collection unit 60 to the stacker unit 80.

The movable roller 62 is installed so as to be movable around a rotary shaft 62*a*, and is retreated from the discharging roller 61 when sheets P are collected on the sheet collection unit 60. Also, after a bundle B of sheets is made on the sheet collection unit 60, the movable roller is pressed against the bundle B of sheets to send the bundle of sheets to the stacker unit 80.

Processing which is performed in the post-processing apparatus 2 will be described.

In the present exemplary embodiment, the main-body control unit 106 outputs an instruction signal to perform processing on sheets P, to the sheet-processing control unit 23. If the sheet-processing control unit 23 receives the instruction signal, the post-processing apparatus 2 performs the processing on the sheets P.

In the processing which is performed in the post-processing apparatus 2, first, sheets P subjected to image formation of the image forming apparatus 1 are supplied to the transport unit 21 of the post-processing apparatus 2. The transport unit 21 performs punching by the punching unit 30 according to the instruction signal from the sheet-processing control unit 23, and then conveys the sheets P toward the finisher unit 22 by the conveying rollers 211.

However, in the case where there is no punching instruction from the sheet-processing control unit 23, the transport unit conveys the sheets P to the finisher unit 22 without performing a punching process by the punching unit 30.

The sheets P conveyed to the finisher unit 22 are conveyed to the sheet collection unit 60 included in the binding device 600. Subsequently, the sheets P slide on the sheet collection unit 60 due to the angle of tilt of the sheet collection unit 60, thereby coming up against sheet regulating units 64 provided at an end of the sheet collection unit 60.

As a result, the sheets P stops moving. In the present exemplary embodiment, since the sheets P come up against the sheet regulating units 64, the rear ends of the sheets P are made even on the sheet collection unit 60, whereby a bundle B of sheets is made. Also, in the present exemplary embodiment, the binding device includes rotating paddles 63 for moving sheets P toward the sheet regulating units 64.

<Configuration of Binding Device>

Figure 3:
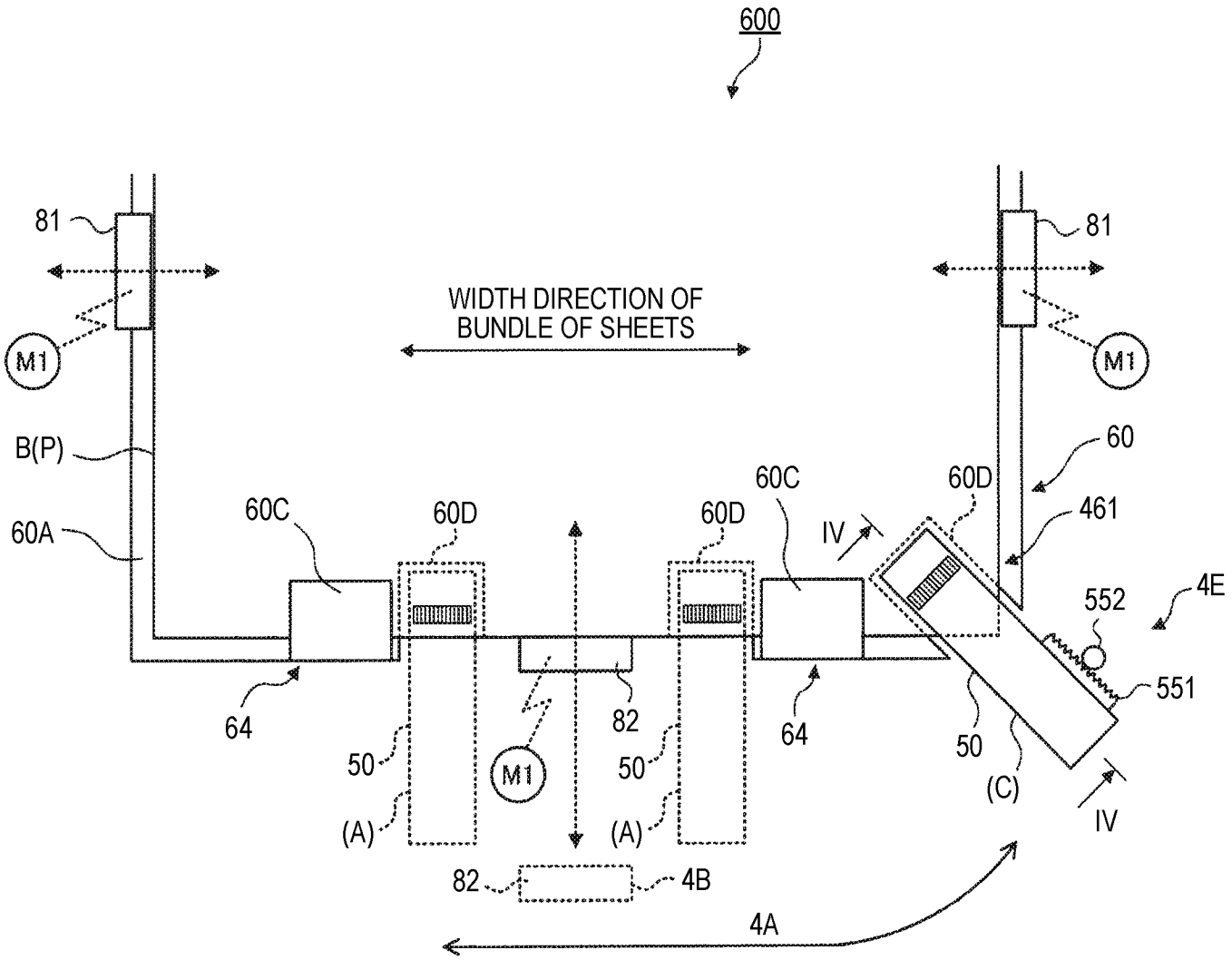
FIG. 3 is a view illustrating a binding device as seen from above.

FIG. 3 is a view illustrating the binding device 600 as seen from above.

The sheet collection unit 60 has first movable members 81 installed at both ends in the width direction.

The first movable members 81 are pressed against sides of sheets P constituting a bundle B of sheets, thereby making the ends of the sheets P constituting the bundle B of sheets even. Also, the first movable members 81 move in the width direction of the bundle B of sheets, thereby moving the bundle B of sheets in the width direction of the bundle B of sheets.

Specifically, in the present exemplary embodiment, when sheets P are collected on the sheet collection unit 60, the first movable members 81 are pressed against the sides of the sheets P, whereby making the sides of the sheets P even.

Also, as will be described below, in the case where the binding position of a bundle B of sheets is changed, the bundle B of sheets is pressed by the first movable members 81 and the bundle B of sheets is moved in the width direction of the bundle B of sheets.

Further, the binding device 600 of the present exemplary embodiment includes a second movable member 82.

The second movable member 82 moves in the up-and-down direction of FIG. 3 to move a bundle B of sheets in a direction perpendicular to the width direction of the bundle B of sheets.

Further, in the present exemplary embodiment, the binding device has a motor M1 for movement configured to move the first movable members 81 and the second movable member 82.

As shown by an arrow 4A in FIG. 3, the binding unit 50 is installed so as to be movable in the width direction of sheets P. Further, the binding unit 50 performs a binding process (a two-point binding process), for example, on two points (Position A and Position B) positioned in different parts in the width direction of a bundle B of sheets.

Also, the binding unit 50 moves to Position C of FIG. 3, and performs a binding process on a corner of the bundle B of sheets.

Between Position A and Position B, the binding unit 50 moves straight; whereas between Position A and Position C, the binding unit 50 moves while rotating, for example, 45°.

The sheet regulating units 64 are formed in a C shape having corners. Inside the sheet regulating units 64 having the C shape having the corners, regulating parts (not shown in the drawings) are provided so as to extend upward from a bottom plate 60A, and the regulating parts come into contact with the leading ends of sheets P conveyed, thereby regulating movement of the sheets P. Also, the sheet regulating units 64 have facing parts 60C disposed so as to face the bottom plate 60A. The facing parts 60C come into contact with the uppermost sheet P of a bundle B of sheets, thereby regulating movement of the sheets P in the thickness direction of the bundle B of sheets.

In the present exemplary embodiment, at parts where there are no sheet regulating units 64 and no second movable member 82, the binding process of the binding unit 50 is performed.

Specifically, as shown in FIG. 3, between the sheet regulating unit 64 positioned on the left side of FIG. 3 and the second movable member 82 and between the sheet regulating unit 64 positioned on the right side of FIG. 3 and the second movable member 82, the binding process of the binding unit 50 is performed. Further, in the present exemplary embodiment, at a part (a corner of a bundle B of sheets) adjacent to the sheet regulating unit 64 positioned on the right side of FIG. 3, the binding process is performed.

Also, as shown in FIG. 3, the bottom plate 60A has three notches 60D. As a result, interference between the sheet collection unit 60 and the binding unit 50 is prevented.

Also, in the present exemplary embodiment, when the binding unit 50 moves, the second movable member 82 moves to a position shown by a reference symbol "4B" in FIG. 3. As a result, interference between the binding unit 50 and the second movable member 82 is prevented.

Figure 4A:
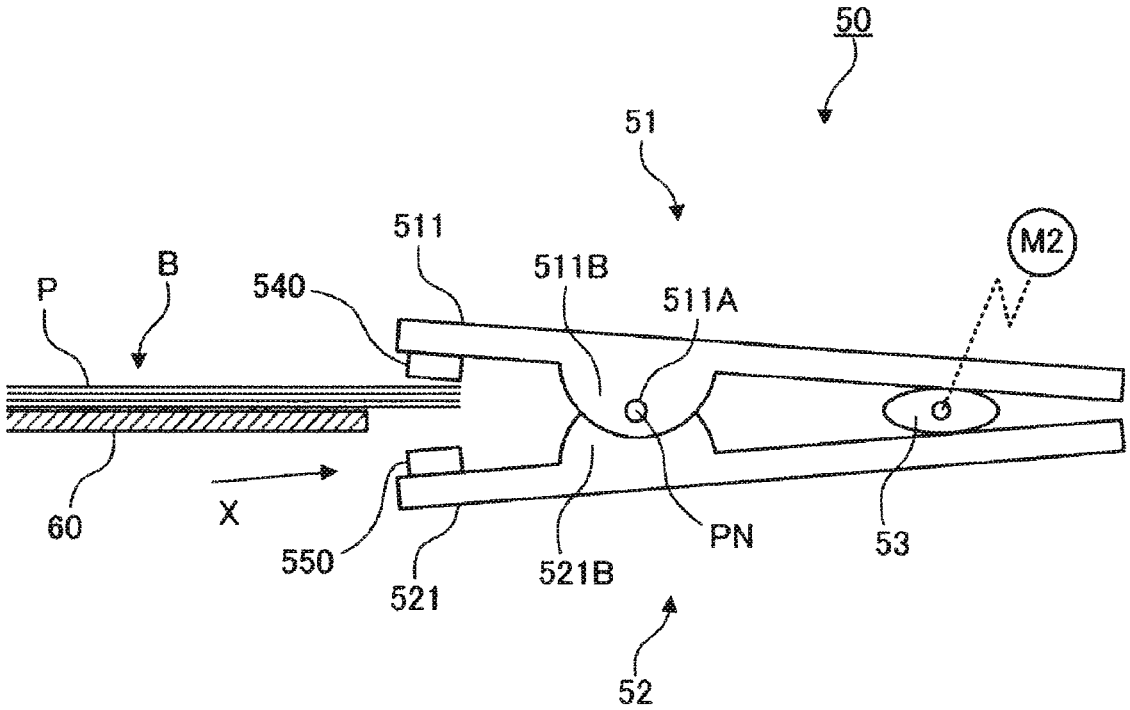
FIG. 4A is a cross-sectional view taken along a line IV-IV of FIG. 3, and is a view illustrating a state where drive parts are open.
Figure 4B:
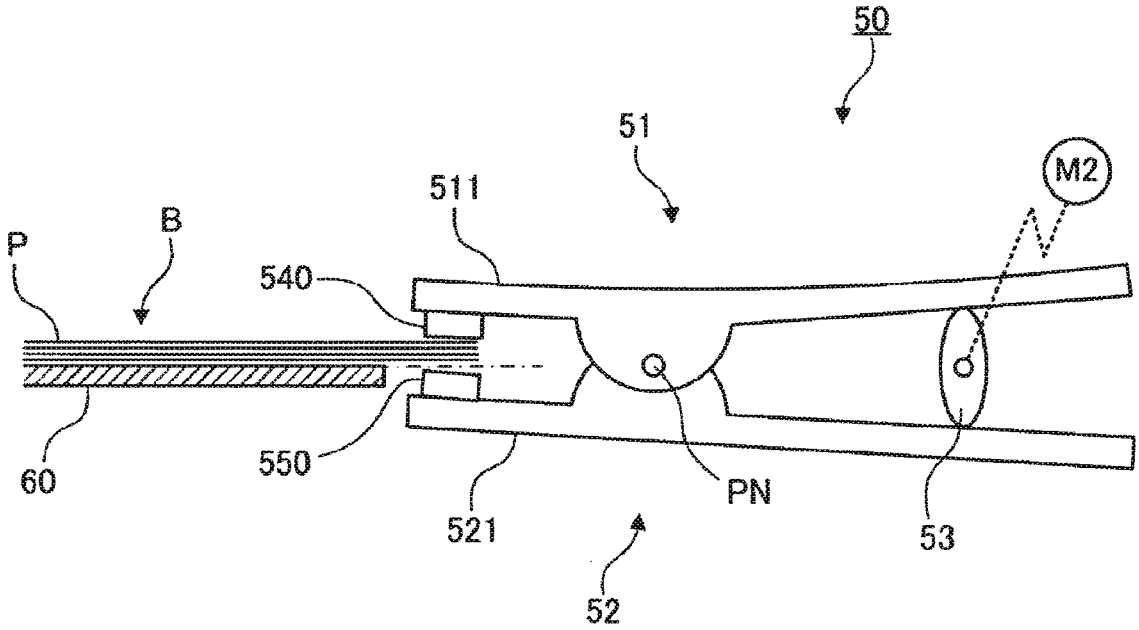
FIG. 4B is a cross-sectional view taken along the line IV-IV of FIG. 3, and is a view illustrating a state where the drive parts are closed.

FIGS. 4A and 4B are cross-sectional views taken along a line IV-IV of FIG. 3.

As shown in FIG. 4A, the binding unit 50 includes a first drive unit 51 extending in the left-right direction of FIG. 4A, a second drive unit 52 extending similarly in the left-right direction of FIG. 4A, an ellipsoidal cam 53 disposed between the first drive unit 51 and the second drive unit 52, and a cam motor M2 configured to drive the cam 53.

The first drive unit 51 has a drive part 511. The drive part 511 has a plate-like shape, and has one end part to overlap a bundle B of sheets, and anther end part positioned on the opposite side to the one end part.

In the present exemplary embodiment, the one end part of the drive part 511 has an upper toothed part 540 attached thereon. The upper toothed part 540 advances from one surface side of a bundle B of sheets toward the bundle B of sheets, thereby pressing the bundle B of sheets. Also, the drive part 511 has projections 511B projecting toward the second drive unit 52, and the projections 511B have through-holes 511A.

As shown in FIG. 4A, the second drive unit 52 has a drive part 521. The drive part 521 has a plate-like shape, and has one end part to overlap a bundle B of sheets, and anther end part positioned on the opposite side to the one end part. In the present exemplary embodiment, the one end part of the drive part 521 has a lower toothed part 550 attached thereon. The lower toothed part 550 advances toward the other surface of the bundle B of sheets, thereby pressing the bundle B of sheets.

Also, the drive part 521 has projections 521B projecting toward the first drive unit 51, and the projections 521B have through-holes (which are positioned on the rear surfaces of the through-holes 511A of the first drive unit 51 and are not shown in the drawings).

Also, in the present exemplary embodiment, the through-holes 511A formed in the first drive unit 51 and the through-holes (not shown in the drawings) formed in the second drive unit 52 have a pin PN inserted therein. In the present exemplary embodiment, the drive part 511 and the drive part 521 swing on the pin PN.

Further, in the present exemplary embodiment, the upper toothed part 540 and the lower toothed part 550 are closer to a bundle B of sheets than to the pin PN, and the cam 53 is on the opposite side of the pin PN to a bundle B of sheets.

In the present exemplary embodiment, if the cam 53 is rotated by the cam motor M2, as shown in FIG. 4B, the upper toothed part 540 and the lower toothed part 550 move toward each other, and the upper toothed part 540 and the lower toothed part 550 pinch a bundle B of sheets and presses the bundle B of sheets. As a result, fibers of the sheets P constituting the bundle B of sheets are tangled, whereby neighboring sheets P are joined and the bundle B of sheets bound is made. In the present exemplary embodiment, the structure having the upper toothed part 540 and the lower toothed part 550 functions as an example of a binding member. It is also possible to recognize the binding unit 50 shown in FIGS. 4A and 4B as an example of the binding member. Also, the specific configuration of the binding unit 50, particularly, the mechanism for moving the upper toothed part 540 and the lower toothed part 550 toward each other, thereby pinching a bundle B of sheets is not limited to the configuration described with reference to FIGS. 4A and 4B. Various configurations capable of pinching and pressing a bundle B of sheets by upper toothed part 540 and a lower toothed part 550 can be used.

<Configuration of Toothed Parts of Binding Unit>

Figure 5:
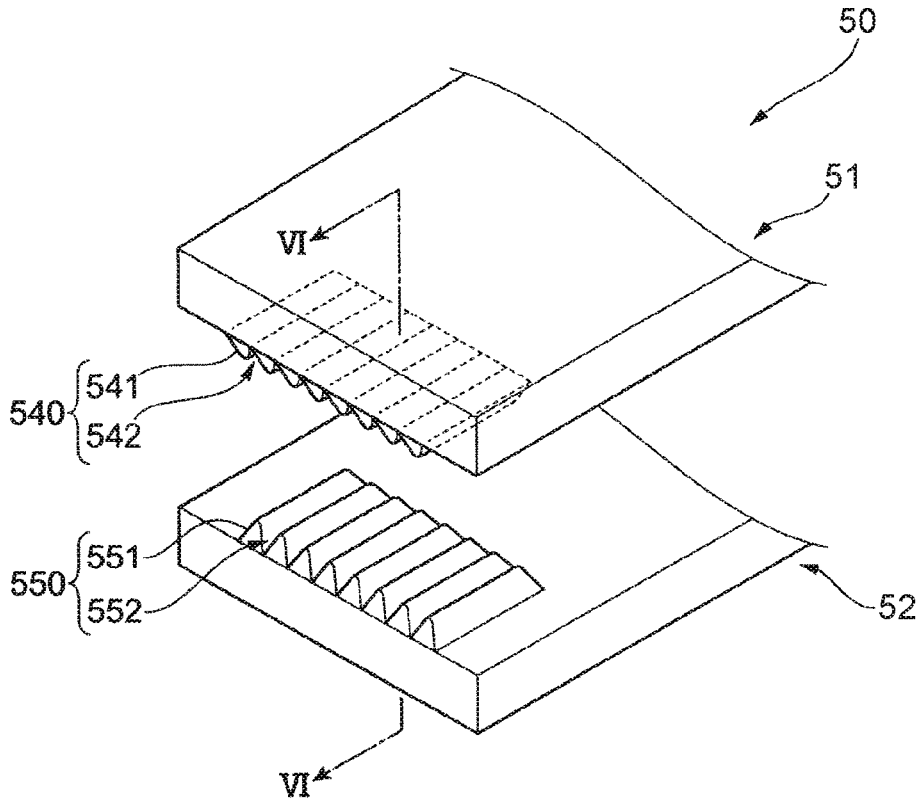
FIG. 5 is an enlarged perspective view illustrating a drive part of a first drive unit and a drive part of a second drive unit included in a binding unit of the exemplary embodiment.

FIG. 5 is an enlarged perspective view illustrating parts of the drive part 511 of the first drive unit 51 and the drive part 521 of the second drive unit 52 included in the binding unit 50 of the present exemplary embodiment.

The drive part 511 has the upper toothed part 540, and the drive part 521 has the lower toothed part 550. The upper toothed part 540 are positioned on one side of the drive part 511 facing the second drive unit 52 so as to correspond to the lower toothed part 550. The lower toothed part 550 are positioned on one side of the drive part 521 facing the first drive unit 51 so as to correspond to the upper toothed part 540.

As shown in FIG. 5, the upper toothed part 540 has ridge-like projections 541 and groove-like recesses 542 alternately arranged, and has, as a whole, a band shape having the length of the projections 541 and the recesses 542 as its width, and the lower toothed part 550 has ridge-like projections 551 and groove-like recesses 552 alternately arranged, and has, as a whole, a band shape having the length of the projections 551 and the recesses 552 as its width. Also, the projections 541 of the upper toothed part 540, the recesses 552 of the lower toothed part 550, the recesses 542 of the upper toothed part 540, and the projections 551 of the lower toothed part 550 are arranged such that if the drive part 511 and the drive part 521 come toward each other, the projections 541 of the upper toothed part 540 and the recesses 552 of the lower toothed part 550 are engaged and the recesses 542 of the upper toothed part 540 and the projections 551 of the lower toothed part 550 are engaged.

<Shapes of Toothed Parts of Binding Device>

Figure 6A:
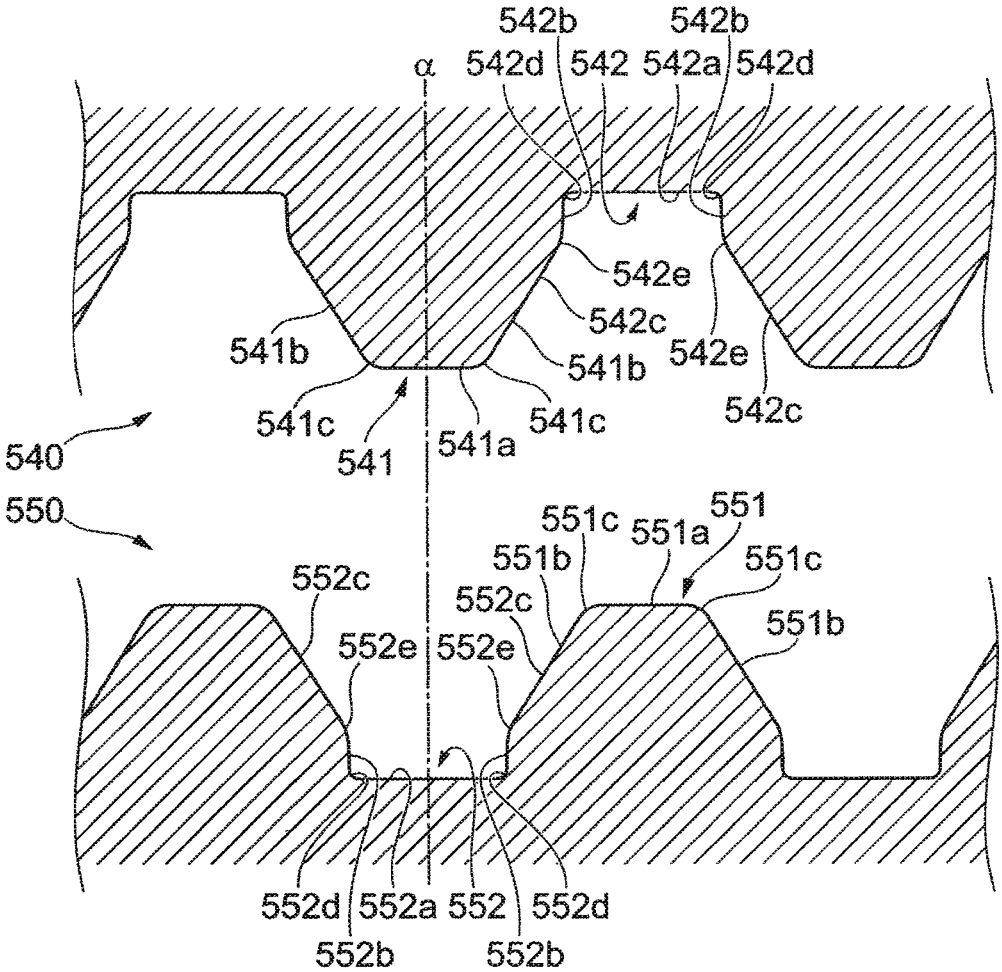
FIG. 6A is an enlarged view illustrating a cross section of the drive parts taken along a line VI-VI of FIG. 5, and is a view illustrating a state where the drive parts are open.
Figure 6B:
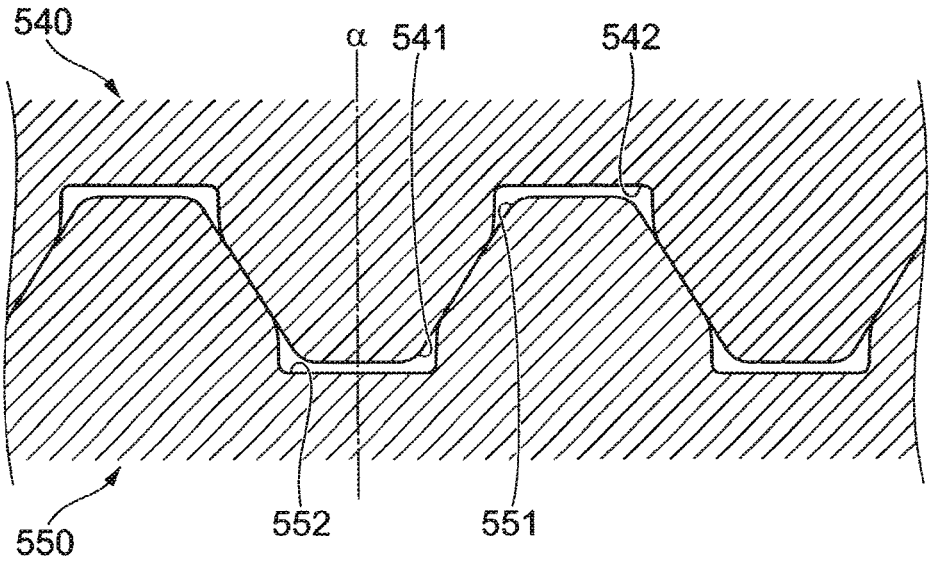
FIG. 6B is an enlarged view illustrating a cross section of the drive parts taken along the line VI-VI of FIG. 5, and is a view illustrating a state where the drive parts have been moved toward each other and an upper toothed part and a lower toothed part have been engaged with each other, without a bundle of sheets interposed therebetween.

FIGS. 6A and 6B are enlarged views illustrating a cross section of the drive parts 511 and 521 taken along a line VI-VI of FIG. 5.

With reference to FIGS. 6A and 6B, an example of the shapes of the toothed parts (the upper toothed part 540 and the lower toothed part 550) of the binding unit 50 of the binding device 600 will be described. FIG. 6A is a view illustrating a state where the drive parts 511 and 521 are open, and FIG. 6B is a view illustrating a state where the drive parts 511 and 521 have been moved toward each other and the upper toothed part 540 and the lower toothed part 550 have been engaged with each other without a bundle B of sheets interposed therebetween.

With reference to FIG. 6A, the shape of the projections 541 of the upper toothed part 540 will be described. In the example shown in FIG. 6A, the projections 551 have trapezoidal cross section shapes having rounded corners. In other words, each projection 541 is formed by a planer top surface 541*a*, side surfaces 541*b* which are inclined surfaces, and convex surfaces 541*c* connecting the top surface 541*a* and the side surfaces 541*b*. Further, in the cross section shown in FIG. 6A, each projection 541 has a line-symmetric shape with respect to a straight line a halving the top surface 541*a* (i.e. a virtual line a passing through the center of the corresponding projection 541). Also, in the example shown in FIG. 6A, the side surfaces 541*b* are planer surfaces. Also, the projections 551 of the lower toothed part 550 are formed similarly. In other words, each projection 551 is formed by a top surface 551*a*, side surfaces 551*b*, and convex surfaces 551*c*.

With reference to FIG. 6A, the shape of the recesses 552 of the lower toothed part 550 will be described. In the example shown in FIG. 6A, each recess 552 is formed by a planer bottom surface 552*a*, first side surfaces 552*b* and second side surfaces 552*c* which are side walls, and concave surfaces 552*d* connecting the bottom surface 552*a* and the first side surfaces 552*b*, and convex surfaces 552*e* connecting the first side surfaces 552*b* and the second side surfaces 552*c*. Further, in the cross section shown in FIG. 6A, each recess 552 has a line-symmetric shape with respect to a straight line a halving the bottom surface 552*a*. Also, in the example shown in FIG. 6A, the second side surfaces 552*c* are planar surfaces inclined at the same angle as that of the side surfaces 541*b* of the projections 541. Also, the first side surfaces 552*b* are planer surfaces steeper than the second side surfaces 552*c* (the angle between the first side surfaces and the bottom surfaces 552*a* is larger than the angle between the second side surface 552*c* and the bottom surfaces 552*a*). Also, the recesses 542 of the upper toothed part 540 are formed similarly. In other words, each recess 542 is formed by a bottom surface 542*a*, first side surfaces 542*b*, second side surfaces 542*c*, concave surfaces 542*d*, and convex surfaces 542*e*.

In addition, in the upper toothed part 540 and the lower toothed part 550 shown in FIG. 6A, some parts of the surfaces constituting the projections 541 and the recesses 542 are shared by the projections 541 and the recesses 542 neighboring each other, and some parts of the surfaces constituting the projections 551 and the recesses 552 are shared by the projections 551 and the recesses 552 neighboring each other. Specifically, in the upper toothed part 540, in a projection 541 and a recess 542 neighboring each other, a side surface 541*b* which is an inclined surface of the projection 541 serves as a second side surface 542*c* of the recess 542 neighboring the projection 541. Similarly, in the lower toothed part 550, in a projection 551 and a recess 552 neighboring each other, a side surface 551*b* of the projection 551 which is an inclined surface serves as a second side surface 552*c* of the recess 552 neighboring the projection 551.

With reference to FIG. 6B, the relation between the projections 541 and recesses 542 of the upper toothed part 540 and the recesses 552 and projections 551 of the lower toothed part 550 will be described further. As shown in FIG. 6B, when the upper toothed part 540 and the lower toothed part 550 are moved toward each other without a bundle B of sheets interposed therebetween, the projections 541 of the upper toothed part 540 are fit into the recesses 552 of the lower toothed part 550 and the projections 551 of the lower toothed part 550 are fit into the recesses 542 of the upper toothed part 540. Further, the side surfaces 541*b* of the projections 541 and the second side surfaces 552*c* of the recesses 552 inclined at the same angle come into contact with each other and the side surfaces 551*b* of the projections 551 and the second side surfaces 542*c* of the recesses 542 inclined at the same angle come into contact with each other, whereby the upper toothed part 540 and the lower toothed part 550 are engaged.

Also, the recesses 542 and 552 have the first side surfaces 542*b* and 552*b* and the convex surfaces 542*e* and 552*e*. Therefore, when the upper toothed part 540 and the lower toothed part 550 are engaged, as shown in FIG. 6B, gaps are formed in the vicinities of the top surfaces 551*a* and 541*a* of the projections 551 and 541.

Figure 7:
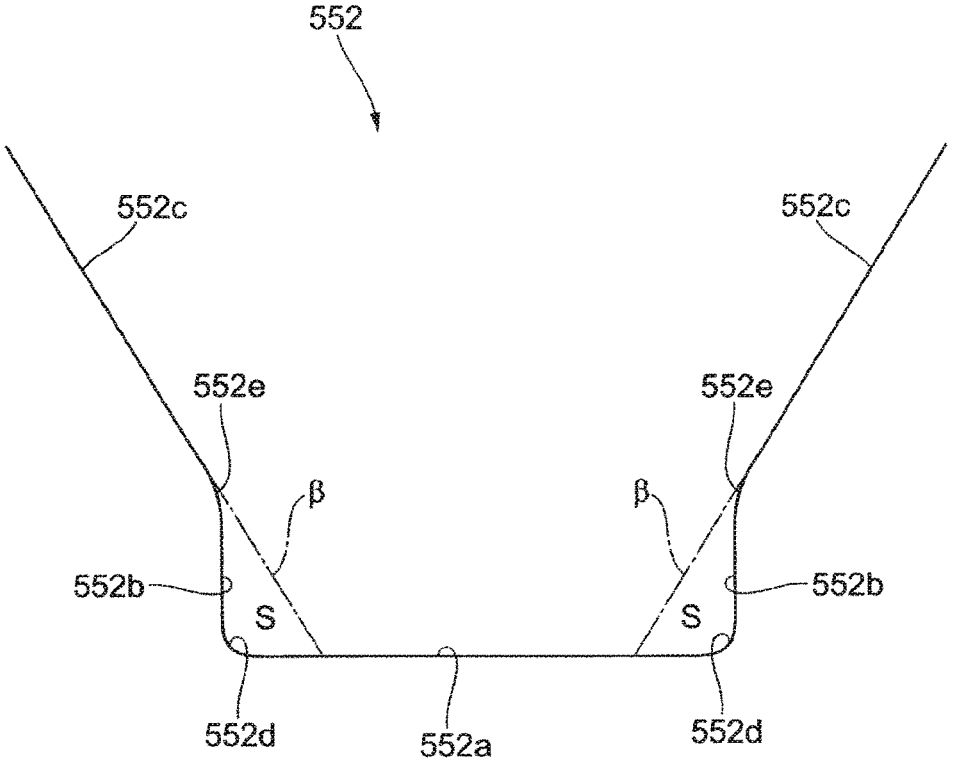
FIG. 7 is an enlarged view illustrating a recess in the lower toothed part shown in FIG. 6A.
Figure 8:
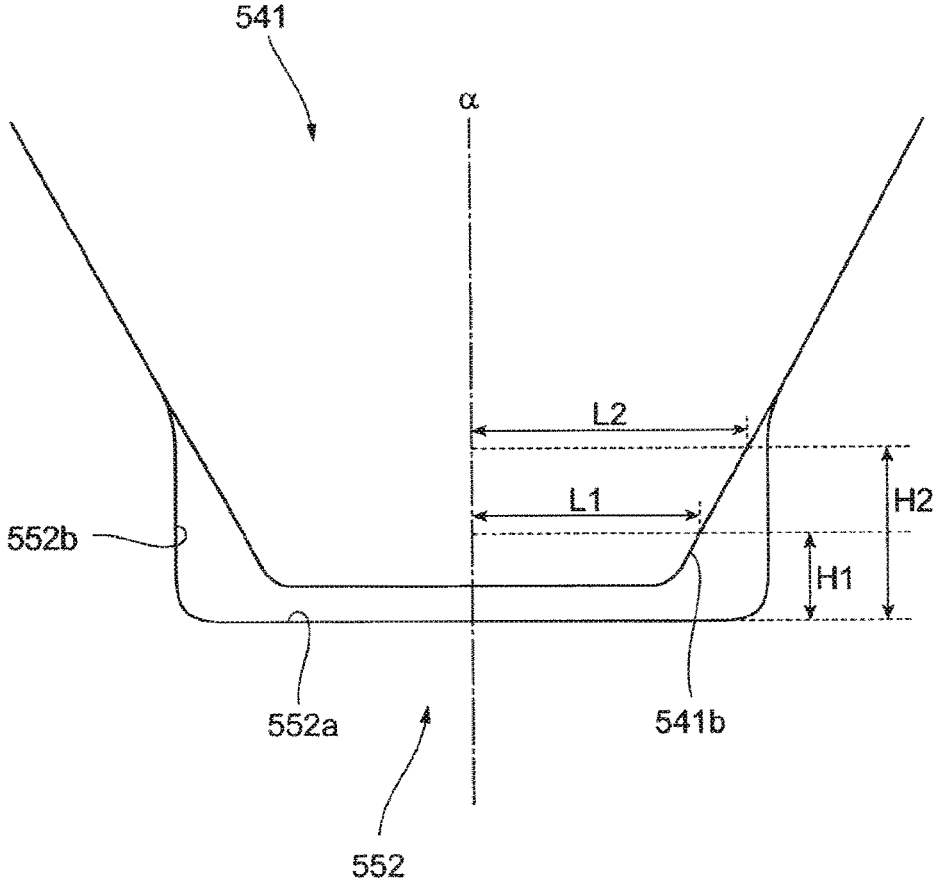
FIG. 8 is an enlarged view illustrating the upper toothed part and the lower toothed part shown in FIG. 6B.

FIG. 7 is an enlarged view illustrating a recess 552 of the lower toothed part 550 shown in FIG. 6A. FIG. 8 is an enlarged view illustrating the upper toothed part 540 and the lower toothed part 550 shown in FIG. 6B.

With reference to FIG. 7 and FIG. 8, the gaps between the projections 541 and 551 and the recesses 552 and 542 shown in FIG. 6B will be described in more detail. As shown in FIG. 7, each recess 552 of the lower toothed part 550 has the first side surfaces 552*b* and the convex surfaces 552*e*. Therefore, each recess 552 has depressed areas S depressed from virtual lines β which are extensions of the second side surfaces 552*c*, at both side parts of the bottom surface 552*a*. In other words, the depressed areas S are areas formed wider than virtual areas which can be formed along the virtual lines β. Further, as described above, when the upper toothed part 540 and the lower toothed part 550 are engaged, the side surfaces 541*b* of the recesses 542 of the upper toothed part 540 and the second side surfaces 552*c* of the recesses 552 of the lower toothed part 550 come into contact with each other. At this time, since the recesses 552 have the depressed areas S, as shown in FIG. 8, the gaps are formed by the first side surfaces 552*b* and the bottom surfaces 552*a* of the recesses 552 and the side surfaces 541*b* of the projections 541.

Although only a recess 552 of the lower toothed part 550 is shown in FIG. 7, the same is true with respect to the recesses 542 of the upper toothed part 540. In other words, each bottom surface 542*a* has depressed areas depressed from virtual lines which are extensions of the second side surfaces 542*c*, at both side parts. Also, although only the combination of a projection 541 of the upper toothed part 540 and a recess 552 of the lower toothed part 550 is shown in FIG. 8, the same is true with respect to the combinations of the projections 551 of the lower toothed part 550 and the recesses 542 of the upper toothed part 540. In other words, gaps are formed by the first side surfaces 542*b* and the bottom surfaces 542*a* of the recesses 542 and the side surfaces 551*b* of the projections 551.

The gaps which are formed when the upper toothed part 540 and the lower toothed part 550 are engaged will be described further. As described above, the gaps are formed by the side surfaces 541*b* and 551*b* of the projections 541 and 551 and the depressed areas S formed in the recesses 552 and 542. Further, the depressed areas S of the recesses 552 and 542 are formed since the recesses 552 and 542 have the convex surfaces 552*e* and 542*e* and the side surfaces of the recesses 552 and 542 are composed of the first side surfaces 552*b* and 542*b* which are first inclined surfaces and the second side surfaces 552*c* and 542*c* which are second inclined surfaces. Here, the concave surfaces 552*d* and 542*d* which are first curved surfaces are concave surfaces; whereas the convex surfaces 552*e* and 542*e* which are second curved surfaces are convex surfaces. In other words, the centers of curvature of the concave surfaces 552*d* and 542*d* and the centers of curvature of the convex surfaces 552*e* and 542*e* exist on the opposite sides with respect to the surfaces of the recesses 552 and 542. Therefore, according to the present exemplary embodiment, since the side surfaces (the first side surfaces 552*b* and 542*b* and the second side surfaces 552*c* and 542*c*) of the recesses 552 and 542 have the convex surfaces 552*e* and 542*e* having the centers of curvature on the opposite side to the centers of curvature of the concave surfaces 552*d* and 542*d* which are concave surfaces for forming the groove shapes of the recesses 552 and 542, the depressed areas S are formed. Therefore, when the upper toothed part 540 and the lower toothed part 550 are engaged, the gaps are formed.

Since the depressed areas S are formed in the above-mentioned way, the gaps are formed when the upper toothed part 540 and the lower toothed part 550 are engaged. In these gaps, the bottom surfaces 552*a* and 542*a* of the recesses 552 and 542 and the side surfaces 541*b* and 551*b* of the projections 541 and 551 satisfy the following relation. In other words, as shown in FIG. 8, it is assumed that when positions on the side surfaces 541*b* and 551*b* of the projections 541 and 551 where the distances between the side surfaces 541*b* and 551*b* and straight lines α halving the top surfaces 541*a* and 551*a* in a direction perpendicular to the straight lines α are a distance L1 are specified, the distances between the specified positions and the bottom surfaces 552*a* and 542*a* of the recesses 552 and 542 are a distance H1. Also, it is assumed that when positions on the side surfaces 541*b* and 551*b* where the distances between the straight lines α and the side surfaces 541*b* and 551*b* are a distance L2 are specified, the distances between the specified positions and the bottom surfaces 552*a* and 542*a* of the recesses 552 and 542 are a distance H2. In this case, a combination of L1 and L2 satisfying that L1 is smaller than L2 and H1 is smaller than H2 always exists. However, all combinations of L1 and L2 including combinations satisfying that L1 is smaller than L2 do not necessarily need to satisfy that H1 is smaller than H2.

Also, with respect to the gaps which are formed when the upper toothed part 540 and the lower toothed part 550 are engaged, as seen from another viewpoint with reference to FIG. 8, it is possible to recognize that the recesses 552 and 542 have wide grooves and gaps are formed due to those grooves when the upper toothed part 540 and the lower toothed part 550 are engaged. In other words, it is possible to recognize that some parts of the side surfaces (the first side surfaces 552*b* and 542*b* and the second side surfaces 552*c* and 542*c*) of the recesses 552 and 542 have the first side surfaces 552*b* and 542*b* as inclined surfaces wider than the side surfaces 541*b* and 551*b* of the projections 541 and 551 in a direction perpendicular to the movement direction of the upper toothed part 540 and the lower toothed part 550 (the pressing direction to a bundle B of sheets).

Now, effects of the upper toothed part 540 and the lower toothed part 550 of the present exemplary embodiment shown in FIGS. 6A and 6B and FIG. 7 will be described by comparison with toothed parts having no depressed areas S.

Figure 9A:
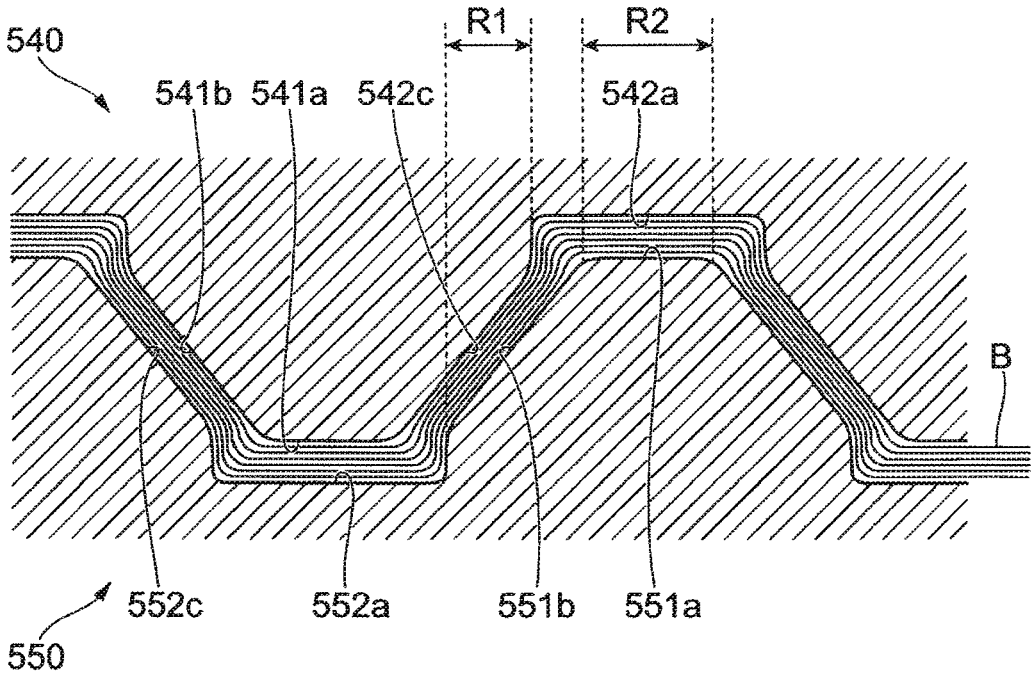
FIG. 9A is a view for comparing a binding process using toothed shapes having recesses having depressed areas and a binding process using toothed shapes having recesses having no depressed areas, and is a view illustrating a state where a bundle of sheets has been interposed between the upper toothed part and the lower toothed part of the exemplary embodiment having recesses having depressed areas and pressure has been applied.
Figure 9B:
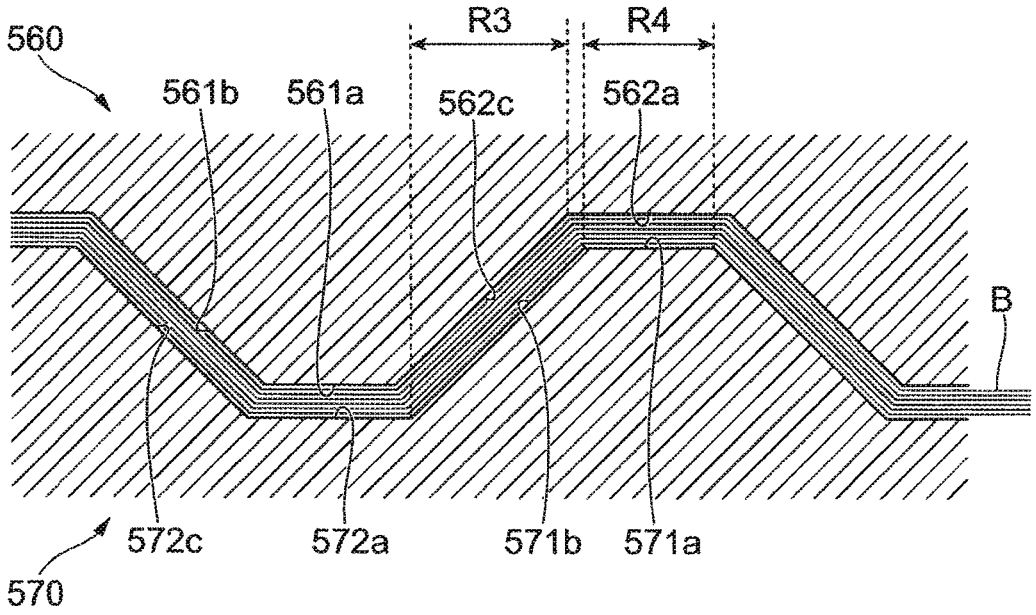
FIG. 9B is a view for comparing a binding process using toothed shapes having recesses having depressed areas and a binding process using toothed shapes having recesses having no depressed areas, and is a view illustrating a state where a bundle of sheets has been interposed between an upper toothed part and a lower toothed part having recesses having no depressed areas and pressure has been applied, as a comparative object.

FIGS. 9A and 9B are views for comparing a binding process using the toothed parts having the recesses having the depressed areas S and a binding process using toothed parts having recesses having no depressed areas S. FIG. 9A is a view illustrating a state where pressure has been applied with a bundle B of sheets interposed between the upper toothed part 540 and the lower toothed part 550 of the present exemplary embodiment having the recesses having the depressed areas S, and FIG. 9B is a view illustrating the state where pressure has been applied with a bundle B of sheets interposed between an upper toothed part 560 and a lower toothed part 570 having recesses having no depressed areas S, as a comparative object.

When the upper toothed part 540 and the lower toothed part 550 are moved toward each other with a bundle B of sheets interposed between the upper toothed part and the lower toothed part, whereby pressure is gradually applied to the bundle B of sheets, as shown in FIG. 9A, the bundle B of sheets is pressed by the projections 541 and 551 of the upper toothed part 540 and the lower toothed part 550, thereby deforming according to the shapes of the projections 541 and 551. Subsequently, when more pressure is applied to the bundle B of sheets, the sheets P of the bundle B of sheets stretch and some fibers of the sheets P fracture. Subsequently, when more pressure is applied to the bundle B of sheets, between the sheets P overlapping, the fractured fibers of the sheets P tangle, whereby the sheets P are bound. Even in the case of FIG. 9B, similarly, as the upper toothed part 560 and the lower toothed part 570 are moved toward each other, whereby pressure is applied to the bundle B of sheets, the bundle B of sheets deforms according to the shapes of projections 561 and 571, and the sheets P stretch, and some fibers of the sheets P fracture. Then, between the sheets P overlapping, the fractured fibers of the sheets P tangle, whereby the sheets P are bound.

In FIG. 9A, some of parts of the bundle B of sheets to which pressure is applied are ranges R1 in which the side surface 541*b* of the projections 541 and 551 of the upper toothed part 540 and the lower toothed part 550 overlap the second side surfaces 552*c* and 542*c* of the recesses 552 and 542. Also, the others of the parts of the bundle B of sheets to which pressure is applied are ranges R2 in which the top surfaces 541*a* and 551*a* of the projections 541 and 551 overlap the bottom surfaces 552*a* and 542*a* of the recesses 552 and 542. Similarly, in FIG. 9B, some of parts of the bundle B of sheets to which pressure is applied are ranges R3 in which side surfaces 561*b* and 571*b* of the projections 561 and 571 of the upper toothed part 560 and the lower toothed part 570 overlap surfaces 572*c* and 562*c* of recesses 572 and 562. Also, the others of the parts of the bundle B of sheets to which pressure is applied are ranges R4 in which top surfaces 561*a* and 571*a* of the projections 561 and 571 overlap bottom surfaces 572*a* and 562*a* of the recesses 572 and 562.

If FIG. 9A and FIG. 9B are compared, in FIG. 9A, since the recesses 542 and 552 have the depressed areas S, the areas of the ranges R1 are smaller than the areas of the ranges R3 in the case of FIG. 9B in which the recesses 562 and 572 have no depressed areas S. In the case where the driving force of the binding unit 50 to move the upper toothed part 540 and the lower toothed part 550 toward each other is equal to the driving force to move the upper toothed part 560 and the lower toothed part 570 toward each other, in the configuration of FIG. 9A in which the areas of the parts of the bundle B of sheets to which pressure is applied are smaller, larger pressure is applied to the bundle B of sheets.

Also, in FIG. 9A, since the recesses 542 and 552 have the depressed areas S, when the sheets P stretch under pressure, the sheets bend and can escape into the gaps formed by the depressed areas S. In contrast with this, in FIG. 9B, since the recesses 562 and 572 have no depressed areas S, when the sheets P stretch under pressure, the sheets bend but cannot escape. Therefore, even in the case where the driving force of the binding unit 50 to move the upper toothed part 540 and the lower toothed part 550 toward each other is equal to the driving force to move the upper toothed part 560 and the lower toothed part 570 toward each other, in the configuration of FIG. 9A in which the recesses 542 and 552 have the depressed areas S, as compared to the configuration of FIG. 9B having no depressed areas S, the sheets P more easily stretch, and fibers of the sheets P more easily fracture and tangle. Therefore, the parts of the bundle B of sheets in the ranges R1 of the configuration of FIG. 9A to which pressure is applied are bound with a stronger binding force, as compared to the parts of the bundle of sheets in the ranges R3 of the configuration of FIG. 9B to which the same pressure is applied.

In the present embodiment, in the recesses 542 and 552, the angle between the first side surfaces 542*b* and 552*b* and the bottom surfaces 542*a* and 552*a* is larger than the angle between the second side surfaces 542*c* and 552*c* and the bottom surfaces 542*a* and 552*a*; however, the angle between the first side surfaces 552*b* and the bottom surfaces 552*a* may be set to be smaller than 90°. In this configuration, after pressure is applied to a bundle B of sheets by the upper toothed part 540 and the lower toothed part 550, when the bundle B of sheets is taken off the binding unit, the load for taking the parts of the bundle B of sheets in the depressed areas S off the depressed areas decreases. Therefore, loosening of the bound parts of the bundle B of sheets is suppressed.

Also, in the projections 541 and 551 and the recesses 542 and 552 of the upper toothed part 540 and the lower toothed part 550 described above, the planer surfaces are connected by the curved surfaces (the convex surfaces 541*c* and 551*c* of the projections 541 and 551, and the concave surfaces 542*d* and 552*d* and the convex surfaces 542*e* and 552*e* of the recesses 542 and 552). Since the projections 541 and 551 and the recesses 542 and 552 have the curved surfaces connecting the other surfaces, without edges, when pressure is applied to a bundle B of sheets, the sheets P of the bundle B of sheets is suppressed from being cut by edges of the projections 541 and 551 and the recesses 542 and 552.

Also, in the above-described configuration, all of the recesses 542 and 552 of the upper toothed part 540 and the lower toothed part 550 have the depressed areas S; however, the recesses (the recesses 542 or the recesses 552) of only one of the upper toothed part 540 and the lower toothed part 550 may have depressed areas S. Even in this case, when the recesses having the depressed areas S are engaged with projections facing them, in the recesses, gaps are formed. Therefore, some parts of a bundle B of sheets can escape into the gaps, and thus the binding force of the bundle B of sheets improves.

<Modifications of Toothed Parts of Binding Device>

In the present exemplary embodiment, when the upper toothed part 540 and the lower toothed part 550 are engaged, the gaps are formed. Therefore, when pressure is applied to a bundle B of sheets interposed between the upper toothed part 540 and the lower toothed part 550, some parts of the bundle of sheets can escape into the gaps, and the sheets P of the bundle B of sheets easily stretch. Therefore, the binding force of the bundle B of sheets improves. Therefore, the upper toothed part 540 and the lower toothed part 550 of the binding unit 50 need only to have such shapes that when they are engaged, gaps as described above are formed, and the specific shapes of them are not limited to the shapes described with reference to FIG. 6A to FIG. 9B. Hereinafter, modifications of the upper toothed part 540 and the lower toothed part 550 will be described.

Figure 10A:
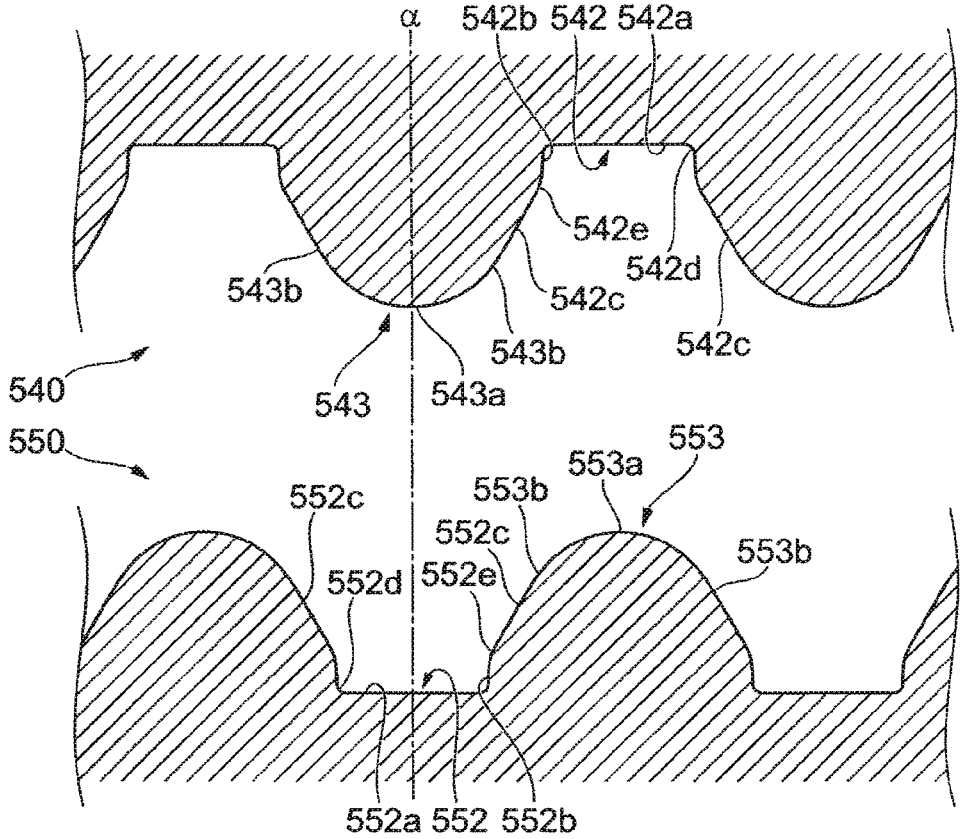
FIG. 10A is a view illustrating a modification of the upper toothed part and the lower toothed part included in the binding unit of the exemplary embodiment, and is a view illustrating a state where drive parts of a binding unit are open.
Figure 10B:
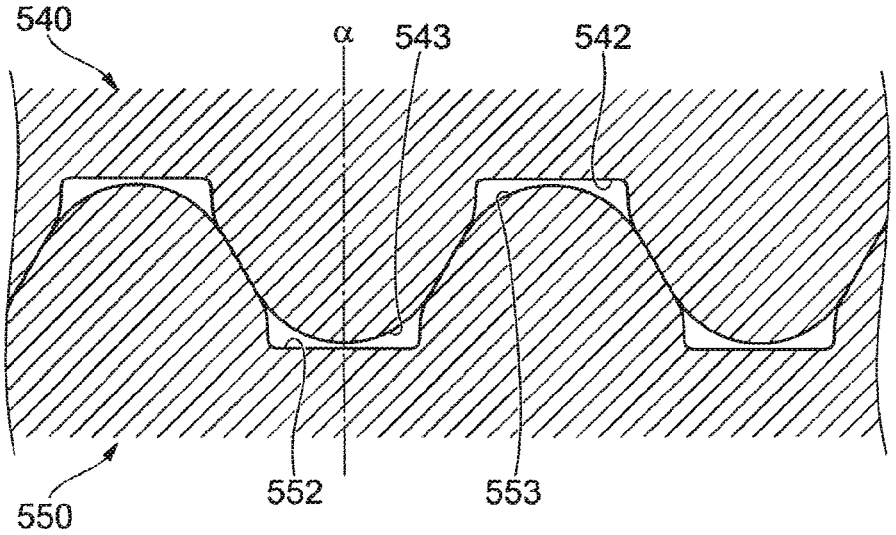
FIG. 10B is a view illustrating the modification of the upper toothed part and the lower toothed part included in the binding unit of the exemplary embodiment, and is a view illustrating a state where the drive parts of the binding unit have been moved toward each other and an upper toothed part and a lower toothed part have been engaged with each other, without a bundle of sheets interposed therebetween.

FIGS. 10A and 10B are views illustrating a modification of the upper toothed part 540 and the lower toothed part 550 included in the binding unit 50 of the present exemplary embodiment. FIG. 10A is a view illustrating a state where drive parts 511 and 521 of a binding unit 50 are open, and FIG. 10B is a view illustrating a state where the drive parts 511 and 521 have been moved toward each other and the upper toothed part 540 and the lower toothed part 550 have been engaged with each other without a bundle B of sheets interposed therebetween.

In the upper toothed part 540 and the lower toothed part 550 described with reference to FIG. 6A to FIG. 9B, the projections 541 and 551 have the trapezoidal cross section shapes. In contrast with this, in the upper toothed part 540 and the lower toothed part 550 shown in FIG. 10A, projections 543 and 553 are formed by convex surfaces 543*a* and 553*a* including the apexes of the projections 543 and 553, and side surfaces 543*b* and 553*b* which are inclined surfaces. In other words, the projections 543 and 553 can be recognized as shapes formed by setting the widths of the planer top surfaces 541*a* and 551*a* of the projections 541 and 551 shown in FIG. 6A to 0 and connecting the convex surfaces 541*c* or 551*c* of both sides of each of the top surfaces 541*a* and 551*a* so as to form the convex surfaces 543*a* and 553*a*.

Recesses 542 and 552 shown in FIG. 10A are identical to the recesses 542 and 552, and are denoted by the same reference symbols. In other words, the recesses 542 and 552 are formed by bottom surfaces 542*a* and 552*a*, first side surfaces 542*b* and 552*b*, second side surfaces 542*c* and 552*c*, concave surfaces 542*d* and 552*d*, and convex surfaces 542*e* and 552*e*. Therefore, depressed areas S are formed by the convex surfaces 542*e* and 552*e* and the first side surfaces 542*b* and 552*b*. Further, due to the depressed areas S, as shown in FIG. 10B, gaps are formed in the vicinities of the convex surfaces 543*a* and 553*a* of the projections 543 and 553 when the upper toothed part 540 and the lower toothed part 550 are engaged.

Also, although not particularly shown in the drawings, as apparent from FIG. 10B, with respect to the above-mentioned gaps, the convex surfaces 543*a* and 553*a* of the projections 543 and 553 and the bottom surfaces 552*a* and 542*a* of the recesses 552 and 542 satisfy the relation between L1 and H1 and the relation between L2 and H2 described above with reference to FIG. 8. In other words, it is assumed that when positions on the convex surfaces 543*a* and 553*a* where the distances between the convex surfaces 543*a* and 553*a* and straight lines α halving the convex surfaces 543*a* and 553*a* in a direction perpendicular to the straight lines α are the distance L1 are specified, the distances between the specified positions and the bottom surfaces 552*a* and 542*a* of the recesses 552 and 542 are the distance H1. Also, it is assumed that when positions on the convex surfaces 543*a* and 553*a* where the distances between the straight lines α and the convex surfaces 543*a* and 553*a* are the distance L2 are specified, the distances between the specified positions and the bottom surfaces 552*a* and 542*a* of the recesses 552 and 542 are the distance H2. In this case, a combination of L1 and L2 satisfying that L1 is smaller than L2 and H1 is smaller than H2 always exists. As an example, in the example shown in FIGS. 10A and 10B, attention needs to be paid to the projections 553 of the lower toothed part and the recesses 542 of the upper toothed part facing them. Then, the apex positioned at the center of each projection of the toothed part, and the distance between each pair of a projection and a recess in a direction which is perpendicular to the pressing direction of the toothed parts and passes through a position apart from the center of the corresponding projection are considered. In this case, at each apex position, L1 is 0. Also, since the apexes of the projections are the highest points of the projections, H1 at the apex positions is the shortest distance of the distances between the projections and the bottom surfaces 552*a* and 542*a* of the recesses 552 and 542 in the depressed areas S. Therefore, the relation in which when L1 is smaller than L2, H1 is smaller than H2 is satisfied.

Even according to the toothed shapes described above, when the upper toothed part 540 and the lower toothed part 550 are engaged, the gaps are formed in the vicinities of the convex surfaces 543*a* and 553*a* of the projections 543 and 553. Therefore, when the sheets P of a bundle B of sheets stretch under pressure, some parts of the sheets bend and can escape into the gaps formed by the depressed areas S. Therefore, as compared to the case where the bundle B of sheets is pressed by toothed parts incapable of forming gaps by depressed areas S, the bundle of sheets is bound with a stronger binding force.

Now, the shape of the depressed areas S according to the present modification will be described in more detail. In the present modification, according to the positions of the convex surfaces 542*e* and 552*e* to form the depressed areas S, with respect to the shape of the depressed areas S, plural forms can be considered. As the positions of the convex surfaces 542*e* and 552*e*, various different positions can be taken on the basis of the relations with positions where the convex surfaces 543*a* and 553*a* of the projections 543 and 553 are formed, i.e. positions where the projections 543 and 553 separate from virtual lines β which are extensions of the second side surfaces 542*c* and 552*c*. Hereinafter, the individual forms will be described.

Figure 11:
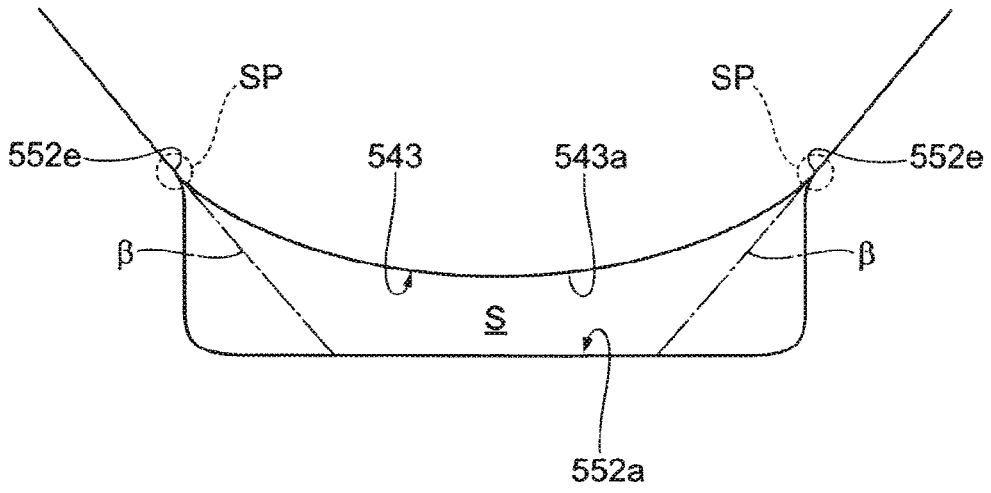
FIG. 11 is a view illustrating a form of the shape of depressed areas of the modification of the toothed parts shown in FIGS. 10A and 10B.

FIG. 11 is a view illustrating a form of the shape of the depressed areas S according to the modification of the toothed parts shown in FIGS. 10A and 10B.

In the example shown in FIG. 11, at positions on the recesses 552 corresponding to positions SP where the projections 543 separate from the virtual lines β which are extensions of the second side surfaces 552*c*, the convex surfaces 552*e* are formed. In other words, the positions SP and the positions of the convex surfaces 552*e* coincide with each other. In the example of FIG. 11, the shape of the depressed areas S which are formed between the recesses 552 of the lower toothed part and the projections 543 of the upper toothed part facing each other has been described; however, the same is true with respect to the shape of depressed areas S which are formed between the recesses 542 of the upper toothed part and the projections 553 of the lower toothed part facing each other.

Figure 12:
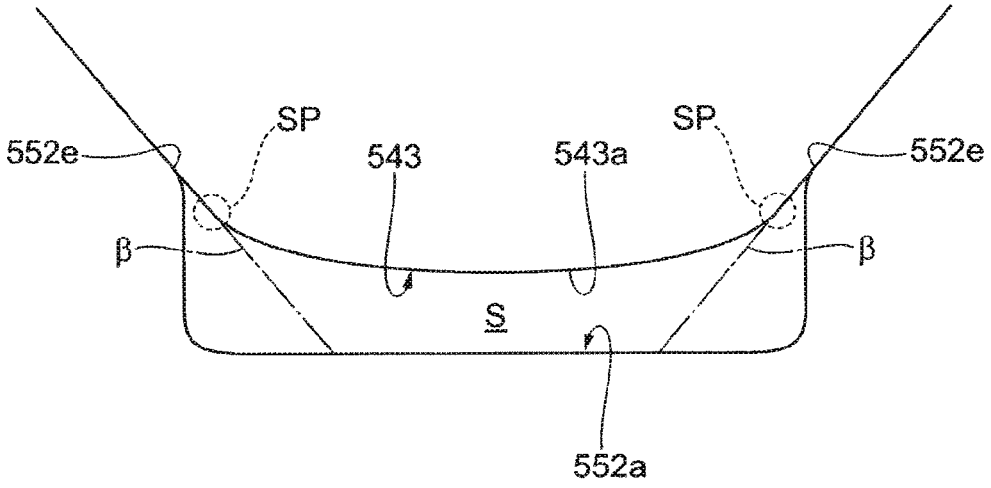
FIG. 12 is a view illustrating another form of the shape of the depressed areas of the modification of the toothed parts shown in FIGS. 10A and 10B.

FIG. 12 is a view illustrating another form of the shape of the depressed areas S according to the modification of the toothed parts shown in FIGS. 10A and 10B.

In the example shown in FIG. 12, at positions on the recesses 552 where the projections 543 overlap the virtual lines β which are extensions of the second side surfaces 552*c*, the convex surfaces 552*e* are formed. Therefore, the positions SP where the projections 543 separate from the virtual lines β are closer to the leading ends than the positions on the projections 543 corresponding to the convex surfaces 552*e* are. In the example of FIG. 12, the shape of the depressed areas S which are formed between the recesses 552 of the lower toothed part and the projections 543 of the upper toothed part facing each other has been described; however, the same is true with respect to depressed areas S which are formed between the recesses 542 of the upper toothed part and the projections 553 of the lower toothed part facing each other.

Figure 13:
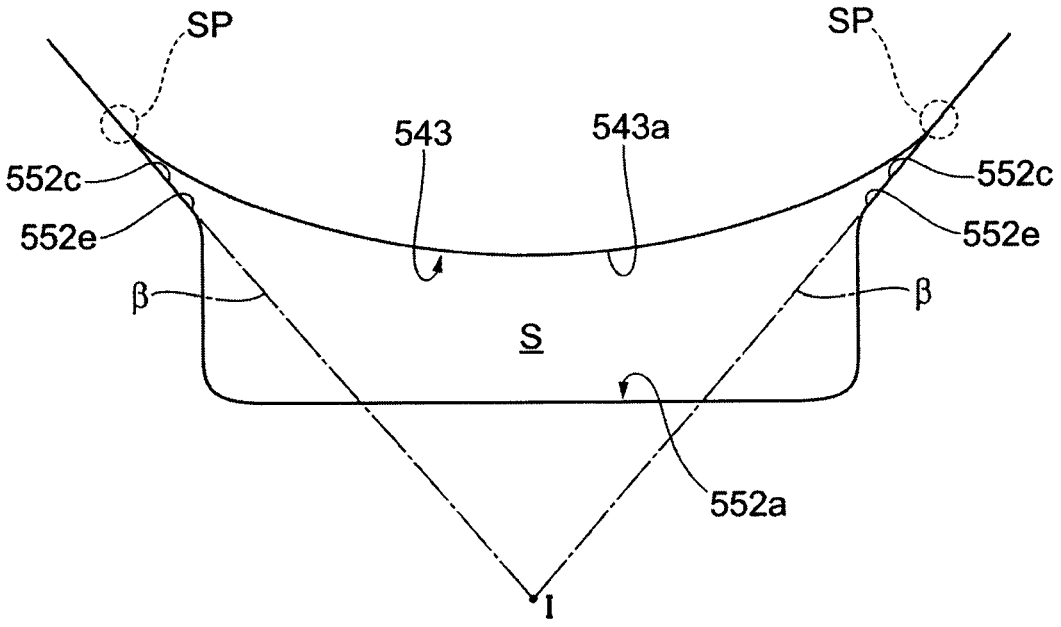
FIG. 13 is a view illustrating a further form of the shape of the depressed areas of the modification of the toothed parts shown in FIGS. 10A and 10B.

FIG. 13 is a view illustrating a further form of the shape of the depressed areas S according to the modification of the toothed parts shown in FIGS. 10A and 10B.

In the example shown in FIG. 13, at positions on the recesses 552 closer to the intersections I of the virtual lines β which are extensions of the second side surfaces 552*c* than the positions SP where the projections 543 separate from the virtual lines β are, the convex surfaces 552*e* are formed. Therefore, at the positions SP, the projections 543 are in contact with the second side surfaces 552*c* of the recesses 552 facing the projections. In the example of FIG. 13, the shape of the depressed areas S which are formed between the recesses 552 of the lower toothed part and the projections 543 of the upper toothed part facing each other has been described; however, the same is true with respect to depressed areas S which are formed between the recesses 542 of the upper toothed part and the projections 553 of the lower toothed part facing each other.

Figure 14:
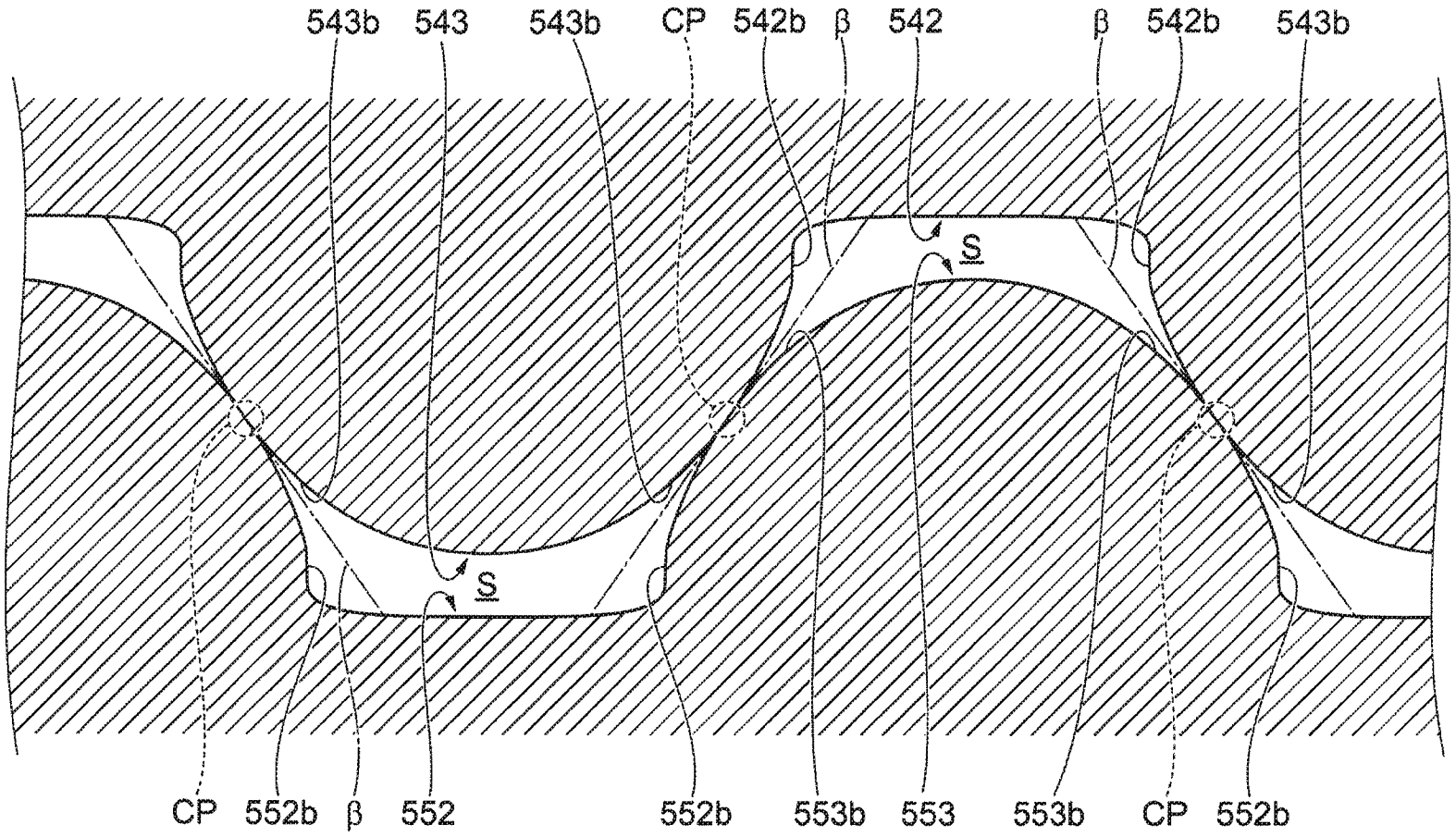
FIG. 14 is a view illustrating a still further form of the shape of the depressed areas of the modification of the toothed parts shown in FIGS. 10A and 10B.

FIG. 14 is a view illustrating a still further form of the shape of the depressed areas S according to the modification of the toothed parts shown in FIGS. 10A and 10B.

In the example shown in FIG. 14, the side surfaces 543*b* and 553*b* of the projections 543 and 553 and the first side surfaces 542*b* and 552*b* of the recesses 542 and 552 neighboring them are smoothly connected. Further, the planer second side surfaces 542*c* and 552*c* and the convex surfaces 542*e* and 552*e* which exist in the toothed parts shown in FIGS. 10A and 10B do not exist. In the case of the above-described shape, when the upper toothed part 540 and the lower toothed part 550 are engaged without a bundle B of sheets interposed therebetween, a projection 543 or 553 and the recess 552 or 542 facing each other come into contact with each other at one point. Such points (contact points) CP where the projections 543 and 553 and the recesses 552 and 542 come into contact with each other can be recognized as examples of parts (contact parts) where the projections 543 and 553 and the recesses 552 and 542 come into contact with each other when the upper toothed part 540 and the lower toothed part 550 are engaged without a bundle B of sheets interposed therebetween. In this case, the tangents at the contact points CP are assumed, and the assumed tangents are used as the virtual lines β. In the configuration example, all pairs of the projections 543 and 553 and the recesses 552 and 542 come into contact with the virtual lines β at the contact points CP. Therefore, in the recesses 552 and 542, the depressed areas S depressed from the virtual lines β are formed.

<Other Modifications of Toothed Parts of Binding Device>

Figure 15A:
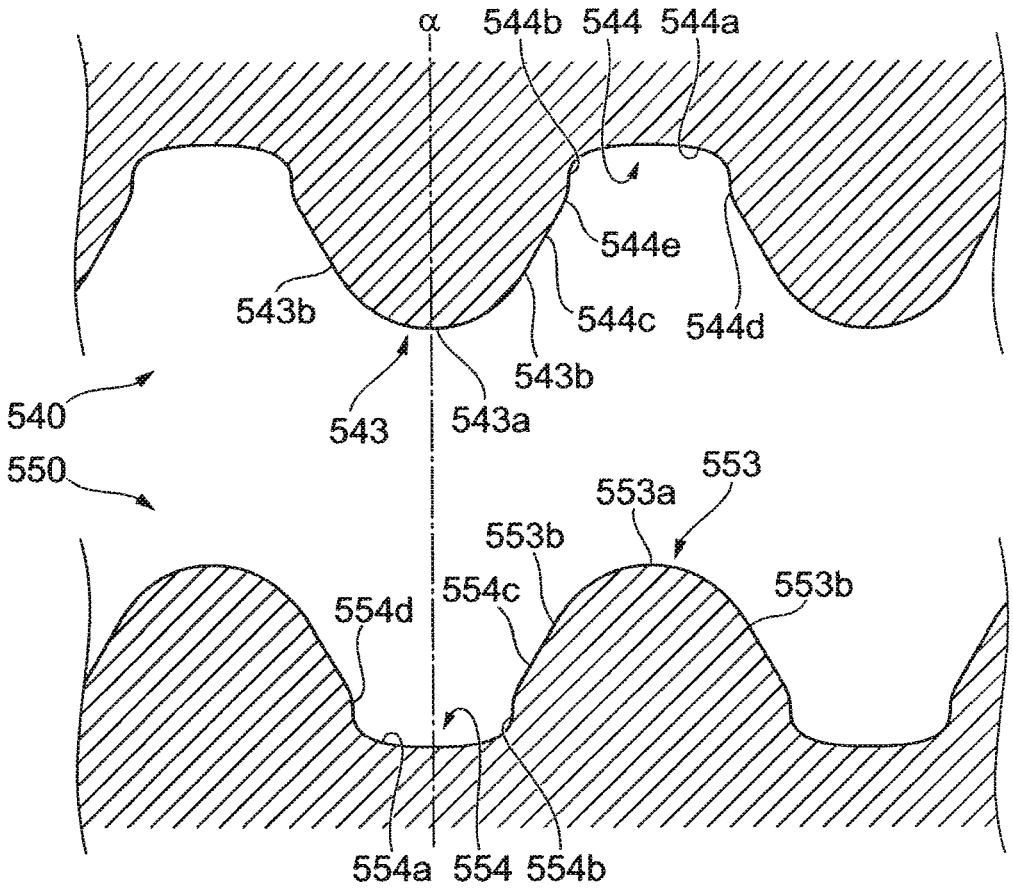
FIG. 15A is a view illustrating another modification of the upper toothed part and the lower toothed part included in the binding unit of the exemplary embodiment, and is a view illustrating a state where drive parts of a binding unit are open.
Figure 15B:
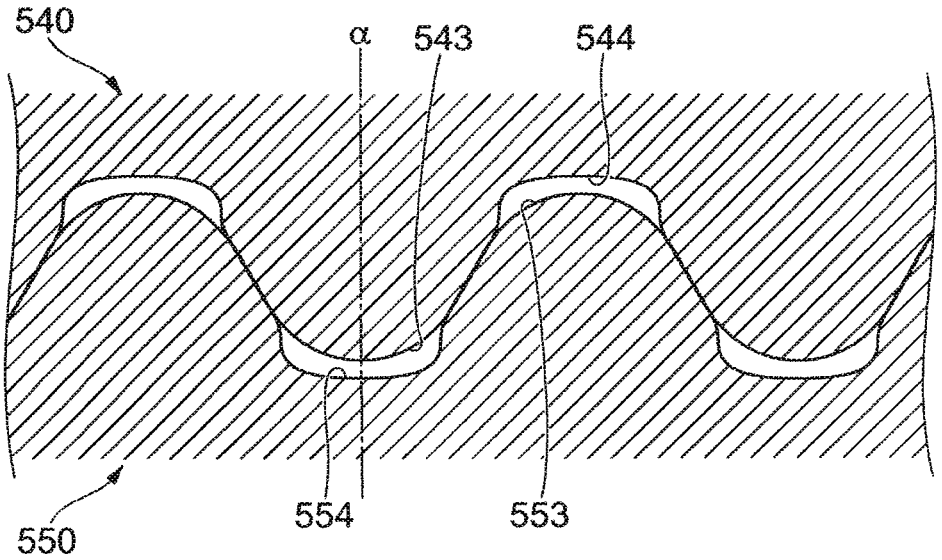
FIG. 15B is a view illustrating the another modification of the upper toothed part and the lower toothed part included in the binding unit of the exemplary embodiment, and is a view illustrating a state where the drive parts of the binding unit have been moved toward each other and an upper toothed part and a lower toothed part have been engaged with each other, without a bundle of sheets interposed therebetween.

FIGS. 15A and 15B are views illustrating another modification of the upper toothed part 540 and the lower toothed part 550 included in the binding unit 50 of the present exemplary embodiment. FIG. 15A is a view illustrating a state where drive parts 511 and 521 of a binding unit 50 are open, and FIG. 15B is a view illustrating a state where the drive parts 511 and 521 have been moved toward each other and an upper toothed part 540 and a lower toothed part 550 have been engaged with each other without a bundle B of sheets interposed therebetween.

In the upper toothed part 540 and the lower toothed part 550 described with reference to FIG. 6A to FIG. 9B, the recesses 542 and 552 have the planer bottom surfaces 542*a* and 552*a*. In contrast with this, in the upper toothed part 540 and the lower toothed part 550 shown in FIG. 15A, recesses 544 and 554 are formed by concaves surfaces 544*a* and 554*a*, first side surfaces 544*b* and 554*b* and second side surfaces 544*c* and 554*c* which are side walls, and convex surfaces 544*d* and 554*d* connecting the first side surfaces 544*b* and 554*b* and the second side surfaces 544*c* and 554*c*. In other words, the recesses 544 and 554 can be recognized as shapes formed by setting the widths of the planer bottom surfaces 542*a* and 552*a* of the recesses 542 and 552 shown in FIG. 6A to 0 and connecting the concave surfaces 542*d* and 552*d* of both sides of each of the bottom surfaces 542*a* and 552*a* so as to form the concaves surfaces 544*a* and 554*a*. As apparent from FIG. 15A, the recesses 544 and 554 have depressed areas S formed by the convex surfaces 544*d* and 554*d* and the first side surfaces 544*b* and 554*b*. Also, the radius of curvature of the concaves surfaces 544*a* and 554*a* is larger than that of the convex surfaces 543*a* and 553*a* of projections 543 and 553.

The projections 543 and 553 shown in FIG. 15A are identical to the projections 543 and 553 shown in FIG. 10A, and are denoted by the same reference symbols. In other words, the projections 553 and 543 are formed by the convex surfaces 543*a* and 553*a* and the side surfaces 543*b* and 553*b*. Therefore, when the upper toothed part 540 and the lower toothed part 550 are engaged, as shown in FIG. 15B, gaps are formed in the vicinities of the convex surfaces 543*a* and 553*a* of the projections 543 and 553.

Also, although not particularly shown in the drawings, as apparent from FIG. 15, since the radius of curvature of the concaves surfaces 554*a* and 544*a* of the recesses 554 and 544 is larger than that of the convex surfaces 543*a* and 553*a* of the projections 543 and 553, with respect to the above-mentioned gaps, the convex surfaces 543*a* and 553*a* of the projections 543 and 553 and the concaves surfaces 554*a* and 544*a* of the recesses 554 and 544 satisfy the relation between L1 and H1 and the relation between L2 and H2 described above with reference to FIG. 8. In other words, it is assumed that when positions on the convex surfaces 543*a* and 553*a* where the distances between the convex surfaces 543*a* and 553*a* and straight lines α halving the convex surfaces 543*a* and 553*a* in a direction perpendicular to the straight lines α are the distance L1 are specified, the distances between the specified positions and the concaves surfaces 554*a* and 544*a* of the recesses 552 and 542 are the distance H1. Also, it is assumed that when positions on the convex surfaces 543*a* and 553*a* where the distances between the straight lines α and the convex surfaces 543*a* and 553*a* are the distance L2 are specified, the distances between the specified positions and the bottom surfaces 552*a* and 542*a* of the recesses 552 and 542 are the distance H2. In this case, a combination of L1 and L2 satisfying that L1 is smaller than L2 and H1 is smaller than H2 always exists.

Even according to the toothed shapes described above, when the upper toothed part 540 and the lower toothed part 550 are engaged, the gaps are formed in the vicinities of the convex surfaces 543*a* and 553*a* of the projections 543 and 553. Therefore, when the sheets P of a bundle B of sheets stretch under pressure, some parts of the sheets bend and can escape into the gaps formed by the depressed areas S. Therefore, as compared to the case where the bundle B of sheets is pressed by toothed parts incapable of forming gaps by depressed areas S, the bundle of sheets is bound with a stronger binding force.

Also, in the individual toothed shapes described above, all of the projections 541, 551, 543, and 553 have the planer side surfaces 541*b*, 551*b*, 543*b*, and 553*b*. Also, the recesses 542, 552, 544, and 554 have the planer second side surfaces 542*c*, 552*c*, 544*c*, and 554*c* corresponding to the planer side surfaces 541*b*, 551*b*, 543*b*, and 553*b*. Further, the recesses 542, 552, 544, and 554 have the depressed areas S depressed from the virtual lines β which are extensions of the second side surfaces 542*c*, 552*c*, 544*c*, and 554*c*. In contrast with this, even in the case where the side surfaces of the projections and the recesses are not planer, it may be possible to form depressed areas S.

Figure 16:
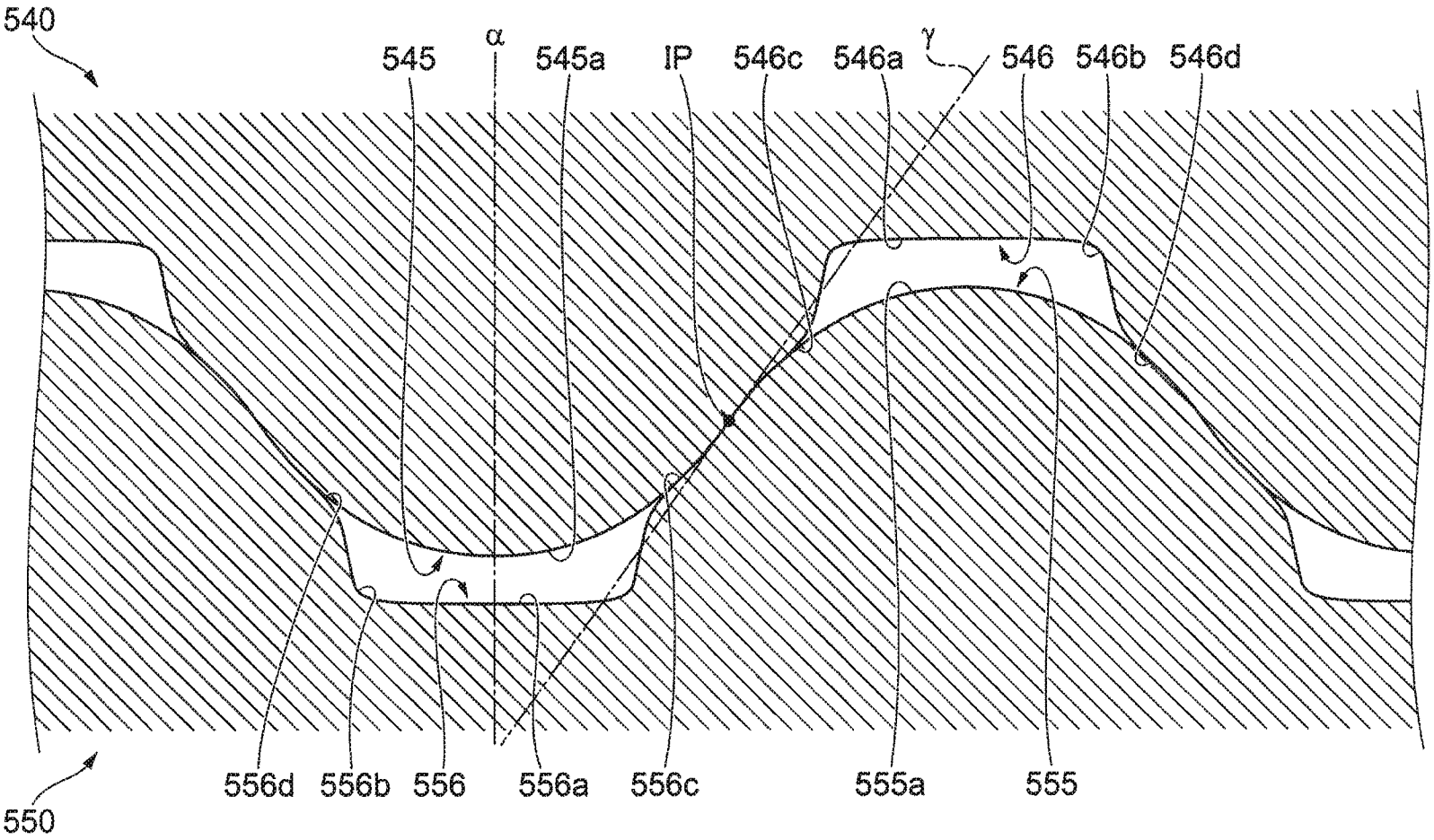
FIG. 16 is a view illustrating an example of toothed parts in which the side surfaces of projections and recesses are curved surfaces.

FIG. 16 is a view illustrating an example of toothed parts in which the side surfaces of projections and recesses are curved surfaces.

Projections 545 and 555 of an upper toothed part 540 and a lower toothed part 550 shown in FIG. 16 are formed by convex surfaces 545*a* and 555*a*. Meanwhile, recesses 546 and 556 are formed by concaves surfaces 546*a* and 556*a*, first side surfaces 546*b* and 556*b* and second side surfaces 546*c* and 556*c* which are side walls, and convex surfaces 546*d* and 556*d* connecting the first side surfaces 546*b* and 556*b* and the second side surfaces 546*c* and 556*c*. Here, some parts of the convex surfaces 545*a* and 555*a* form the side surfaces of the projections 545 and 555. Further, the second side surfaces 546*c* and 556*c* of the recesses 546 and 556 correspond to the side surface parts of the projections 555 and 545 facing them. In other words, the second side surfaces 546*c* and 556*c* are concave surfaces having the same curvature as that of the side surface parts of the projections 555 and 545.

The configuration of the upper toothed part 540 and the lower toothed part 550 shown in FIG. 16 will be described further. First, the projections 545 and 555 are formed by only the convex surfaces 545*a* and 555*a*. Further, at inflection points IP, the side surfaces change to concave surfaces, and become the second side surfaces 546*c* and 556*c* of the recesses 546 and 556. Furthermore, each recess 546 has a convex surface 546*d*, a first side surface 546*b*, and a concave surface 546*a* connected in the order of them, and each recess 556 has a convex surface 556*d*, a first side surface 556*b*, and a concave surface 556*a* connected in the order of them.

As described above, the upper toothed part 540 and the lower toothed part 550 configured by only the curved surfaces also have the convex surfaces 546*d* and 556*d* and the first side surfaces 546*b* and 556*b*, and thus have the depressed areas S. In this example, the depressed areas S may be recognized as areas depressed from the tangents y at the inflection points IP at which change from the convex surfaces 545*a* and 555*a* of the projections 545 and 555 to the second side surfaces 546*c* and 556*c* neighboring them occurs as shown in FIG. 16, not from virtual lines which are extensions of the second side surfaces 546*c* and 556*c* which are concave surfaces.

Figure 17:
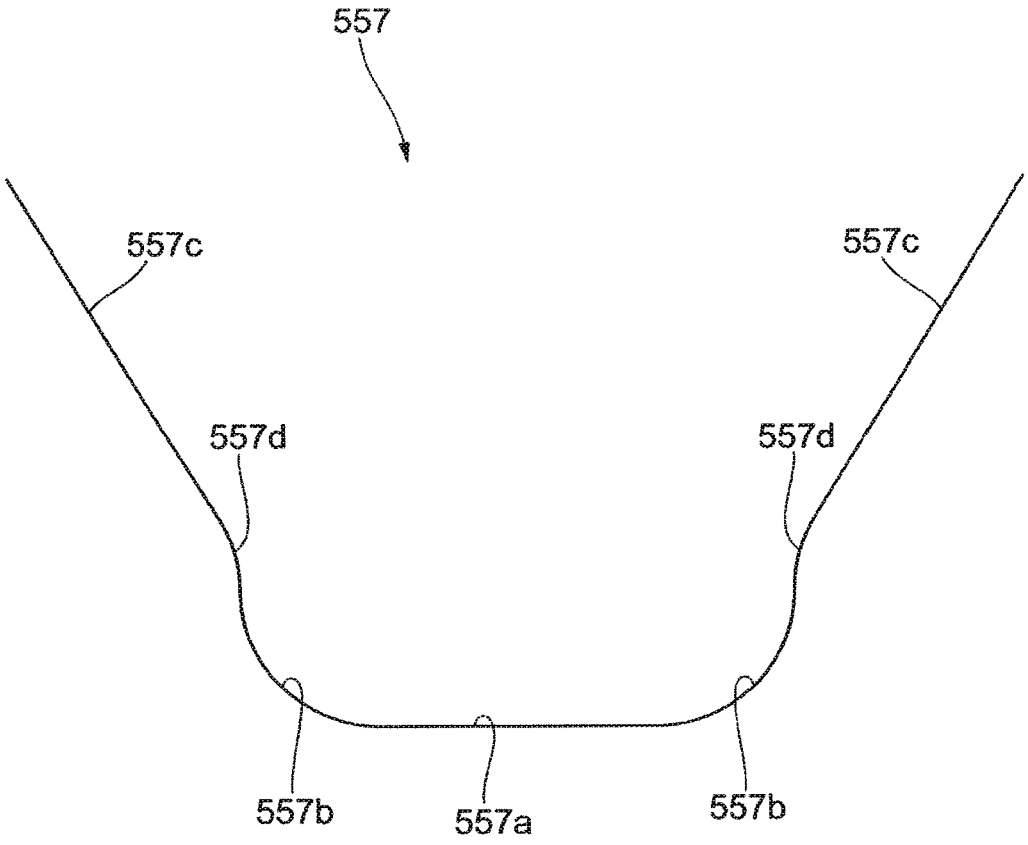
FIG. 17 is a view illustrating a configuration example in which first side surfaces of recesses are curved surfaces.

FIG. 17 is a view illustrating a configuration example in which first side surfaces 557*b* of recesses are curved surfaces.

In FIG. 17, a recess 557 of a lower toothed part is shown. The recess 557 shown in FIG. 17 is formed by a bottom surface 557*a*, first side surfaces 557*b* and second side surfaces 557*c* which are side walls, and convex surfaces 557*d* connecting the first side surfaces 557*b* and the second side surfaces 557*c*. In the example shown in FIG. 17, the first side surfaces 557*b* are curved surfaces and are smoothly connected to the bottom surface 557*a*. In other words, each first side surface 557*b* of the recess 557 can be recognized as a shape formed by integrating a first side surface 552*b* and a concave surface 552*d* shown in FIG. 7.

Although the shape of the upper toothed part 540 and the lower toothed part 550 have been described taking the plural configurations as examples, the present exemplary embodiment needs only to have such a shape that when the upper toothed part 540 and the lower toothed part 550 are engaged, gaps are formed such that when pressure is applied to a bundle B of sheets, the sheets bend and can escape into the gaps, and is not limited to the above-described configuration examples. The configuration examples may be combined, and the present invention can be implemented in various forms without departing from the gist of the present invention.

The foregoing description of the exemplary embodiments of the present invention has been provided for the purpose of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A binding member comprising:

an upper toothed part having projections and recesses for forming irregularities in a bundle of recording materials; and a lower toothed part having projections and recesses for forming irregularities in the bundle of recording materials and forming a pair with the upper toothed part, wherein in at least one of the upper toothed part and the lower toothed part, in a cross section shape of the toothed part, the recesses of the toothed part have depressed areas depressed from virtual lines which are extensions of inclined surfaces of the toothed part.

2. The binding member according to claim 1, wherein:

in the cross section shape of the toothed part, the depressed areas are formed at positions of the recesses corresponding to positions where projections of the other toothed part facing the recesses of the toothed part separate from the virtual lines.

3. The binding member according to claim 1, wherein:

in the cross section shape of the toothed part, the depressed areas are formed as areas wider than virtual areas which can be formed along the virtual lines relative to inclined surfaces of both sides forming each of the recesses.

4. The binding member according to claim 1, wherein:

in the cross section shape of the toothed part, the depressed areas are formed from positions of the recesses corresponding to positions where the projections of the other toothed part facing the recesses of the toothed part and the virtual lines overlap.

5. The binding member according to claim 1, wherein:

in the cross section shape of the toothed part, the depressed areas of each recess are formed at positions closer to the intersection of two virtual lines relative to inclined surfaces of both sides forming the corresponding recess, than positions where a projection of the other toothed part facing the corresponding recess of the toothed part separates from the corresponding virtual lines are.

6. The binding member according to claim 1, wherein:

in the cross section shape of the toothed part, the depressed areas have shapes depressed from virtual lines tangent to inflection points of the inclined surfaces of the toothed part which are curved surfaces.

7. The binding member according to claim 1, wherein:

in the cross section shape of the toothed part, the depressed areas are formed so as to include side surfaces steeper than the inclined surfaces, and convex surfaces connecting the inclined surfaces and the side surfaces.

8. A binding device comprising:

a holding unit configured to hold a bundle of recording materials; and a binding member configured to have an upper toothed part and a lower toothed part forming a pair and perform a binding process of forming irregularities in the bundle of recording materials held by the holding unit, wherein in a cross section shape of at least one of the upper toothed part and the lower toothed part included in the binding member, recesses of the toothed part have depressed areas depressed from virtual lines which are extensions of inclined surfaces of the toothed part.

9. An image processing apparatus comprising:

an image forming unit configured to form images on recording materials; and a binding unit configured to have an upper toothed part and a lower toothed part forming a pair and perform a binding process of forming irregularities in a bundle of recording materials having images formed by the image forming unit, wherein in a cross section shape of at least one of the upper toothed part and the lower toothed part included in the binding member, recesses of the toothed part have depressed areas depressed from virtual lines which are extensions of inclined surfaces of the toothed part.

* * * * *